US006045220A

United States Patent [19]

Kiyohara et al.

[11] Patent Number: 6,045,220

[45] Date of Patent: Apr. 4, 2000

[54] SHEET SUPPLY APPARATUS

[75] Inventors: Takehiko Kiyohara, Zama; Soichi Hiramatsu, Hachioji; Hideki Yamaguchi; Hiroyuki Inoue, both of Yokohama; Takashi Nojima, Mitaka; Hitoshi Nakamura, Kawasaki; Akira Kida, Yokohama; Hideaki Kawakami, Yokohama; Takeshi Iwasaki, Yokohama, all of Japan

[73] Assignee: Canon Kabushiki Kaisha, Tokyo, Japan

[21] Appl. No.: 08/392,221

[22] Filed: Feb. 22, 1995

[30] Foreign Application Priority Data

Jul. 29, 1994 [JP] Japan ..... 6-178499
Feb. 1, 1995 [JP] Japan ..... 7-015063

[51] Int. Cl.[7] ..... B41J 2/01; B65H 3/06; B65H 3/52

[52] U.S. Cl. ..... 347/104; 271/117; 271/121; 271/126

[58] Field of Search ..... 347/104; 346/134; 400/630; 271/117, 118, 121, 126, 127

[56] References Cited

U.S. PATENT DOCUMENTS

| | | | |
|---|---|---|---|
| 4,623,138 | 11/1986 | Sakamaki et al. . | |
| 5,026,042 | 6/1991 | Miller | 271/121 |
| 5,348,283 | 9/1994 | Yanagi et al. . | |
| 5,358,230 | 10/1994 | Ikemori et al. . | |
| 5,370,380 | 12/1994 | Suzuki et al. . | |
| 5,485,991 | 1/1996 | Hirano et al. | 271/121 |

FOREIGN PATENT DOCUMENTS

| | | | |
|---|---|---|---|
| 528 434 | 2/1993 | European Pat. Off. . | |
| 528434 | 2/1993 | European Pat. Off. | 271/121 |
| 672 601 | 9/1995 | European Pat. Off. . | |
| 58-47739 | 3/1983 | Japan . | |
| 58-148132 | 9/1983 | Japan | 271/121 |
| 58-202228 | 11/1983 | Japan . | |
| 60-258043 | 12/1985 | Japan . | |
| 62-264140 | 11/1987 | Japan | 271/121 |
| 63-230439 | 9/1988 | Japan . | |
| 2-193834 | 7/1990 | Japan . | |
| 3-13436 | 1/1991 | Japan | 271/121 |
| 3-284547 | 12/1991 | Japan . | |
| 89/03798 | 5/1989 | WIPO . | |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

A sheet supply apparatus has a sheet supporting unit for supporting a plurality of sheets, a sheet supply device for feeding out the sheets supported by the sheet supporting unit, and a separator which can be elastically flexed to change an inclination angle thereof when the separator is urged by a sheet fed out by the sheet supply device for separating the sheet which rides over the separator from the other sheets. The separator is disposed in an inclined condition so that a tip end of an abutment surface, against which the sheets are to be urged and over which the sheet rides, of the separator before flexed is inclined with respect to a normal plane perpendicular to a sheet feeding direction by a predetermined angle toward the sheet supporting unit.

18 Claims, 25 Drawing Sheets

SHEET SUPPLY APPARATUS

BACKGROUND OF THE INVENTION

1. Field of the Invention

The present invention relates to a sheet supply apparatus for supplying a sheet (recording sheet, transfer sheet, photosensitive sheet, electrostatic recording sheet, printing sheet, OHP sheet, envelope, post card, original sheet or the like) from a sheet stacking portion to a sheet treating portion (such as a recording portion, a reading portion, working portion or the like) in a recording apparatus (printer) acting as an information outputting apparatus of a word processor, a personal computer and the like, or in an image forming apparatus such as a copying machine, a facsimile and the like, or other equipments using the sheet, and a recording apparatus having such a sheet supply apparatus.

2. Related Background Art

In sheet supply apparatuses, a function for surely separating a single sheet from a sheet stack is requested. In the past, there has been proposed a technique in which a pawl member is arranged at a front corner of the sheet stack so that, when the sheets are fed out by a sheet supply roller, by flexing only an uppermost sheet to ride over the pawl member, the uppermost sheet is separated from the other sheets. However, even when this technique is used, it is very difficult to separate a sheet which is hard to be flexed (for example, an envelope or a post card having strong resiliency).

On the other hand, in order to separate the sheet which is hard to be flexed (such as an envelope or a post card), a technique is proposed as disclosed in the Japanese Patent Application Laid-open No. 3-284547 (1991). This technique will now be explained with reference to FIG. 28. In FIG. 28, a sheet stacking plate 201 on which sheets are stacked is biased upwardly by a spring member 203. A free roller 204 for regulating a position of an uppermost sheet on the sheet stack is abutted against an upper surface of the sheet stack rested on the sheet stacking plate 210 so that the upper surface of the sheet stack is maintained below a guide surface 205. Further, an inclined surface 207 for separating the sheets is arranged at a downstream side of the sheet stacking plate 201.

A sheet supply roller 206 is a semi-circular roller having a large diameter portion and a small diameter portion. During rotation of the sheet supply roller, when the large diameter portion thereof is contacted with the uppermost sheet on the sheet stack, the sheets are fed out. The sheets fed out by the sheet supply roller 206 are urged against the inclined surface 207, and the uppermost is flexed to ride over the inclined surface 207, thereby separating the uppermost sheet from the other sheets. Since tip ends of the second, third and other sheets are held down by an elastic force of the flexed uppermost sheet, the second, third and other sheets cannot ride over the inclined surface 207. In this way, only the uppermost sheet can surely be separated from the other sheets.

However, in such a sheet separating mechanism, since the tip ends of the second, third and other sheets are held down by the elastic force generated when the sheet is flexed between the inclined surface 207 and a point P (contact point between the sheet and the free roller 204), and, thus, since the elastic force affects a great influence upon the separating operation, it is necessary to select an inclination angle of the inclined surface 207 in accordance with the bending elastic modulus of the sheet. That is to say, when a sheet having the great bending elastic modulus is separated, the inclination angle of the inclined surface must be selected to be smaller so as not to fold the sheet to be fed out; whereas, when a sheet having the small bending elastic modulus is separated, the inclination angle of the inclined surface must be selected to be greater so as to surely hold down the other sheets by the elastic force of the flexed uppermost sheet.

Accordingly, if the inclination angle of the inclined surface 207 is selected to be smaller to permit the separation of the sheet having the great bending elastic modulus (such as an envelope, a post card or the like), for example, when it is desired to separate a sheet (for a copying machine) having a weight of 60–100 grams/$m^2$, the second, third and other sheets cannot be sufficiently held down by the elastic force of the flexed uppermost sheet, with the result that the double-feed of sheets may occur. Thus, this arrangement cannot be used in separation of the sheet (such as plain sheet) having the small bending elastic modulus.

To avoid this, there has been proposed a technique in which plural kinds of sheets having each different bending elastic modulus can be separated by a single separation means, for example, as disclosed in the Japanese Patent Application Laid-open No. 58-202228 (1983). Now, this technique will be briefly explained with reference to FIG. 29.

A sheet stacking plate 301 on which sheets are stacked is biased upwardly by a spring 302, and a position of an uppermost sheet on the sheet stack is regulated by holder pawls 302 disposed in the proximity of left and right front corners of the sheet stack. A sheet supply roller 303 is urged against the uppermost sheet so that, when the sheet supply roller is rotated, the sheet can be fed out. An abutment member 305 provided on a reference surface 304 for regulating tip ends of the stacked sheets is formed from a plastic film or a metal spring plate having a predetermined bending elastic modulus so that the abutment member can be bent or flexed when it is urged by the sheets fed out by the sheet supply roller 303.

In such a sheet supply apparatus, for example, sheets (for a copying machine) having small bending elastic module are separated one by one when a tip end portion of the uppermost sheet is flexed and rides over the holder pawls 302, as is in the conventional separation means of pawl separation type. On the other hand, regarding thick sheets (such as envelopes, post cards) having great bending elastic modulus, the abutment member 305 is greatly flexed by the tip ends of the sheets, with the result that the sheets are successively advanced while sliding on the flexed abutment member. Consequently, the thick sheets are separated one by one. In this way, various kinds of sheets each having different bending elastic modulus can be separated.

Further, as shown in FIG. 30, a thick sheet separating plate 306 may be provided in association with the reference surface. In this case, the thick sheets are separated one by one when the uppermost sheet rides over the separating plate 306 and flexes the abutment member 305.

Further, the Japanese Patent Application Laid-open No. 2-193834 (1990) discloses a technique for separating sheets one by one by using a member similar to the above-mentioned abutment member. In this technique, a sheet stacking plate on which sheets are stacked is urged against a sheet supply roller by springs so that, when the sheet supply roller is rotated, the sheets can be fed out. An abutment member is disposed perpendicular to a sheet supplying direction so that the sheets fed out by the sheet supply roller can be separated one by one when the abutment member is flexed by the sheets. According to this arrangement, various kinds of sheets each having different bending elastic modulus can be separated one by one.

However, in the above-mentioned conventional sheet supply apparatus, there is a danger of occurring the double-feed of sheets due to the poor sheet separation. For example, if a first sheet is adhered to a second sheet by flash and/or an electrostatic force, when these two sheets abut against the abutment member, these two sheets are advanced together while flexing the abutment member, with the result that these sheets cannot be separated from each other.

SUMMARY OF THE INVENTION

The present invention aims to eliminate the above-mentioned conventional drawbacks, and an object of the present invention is to positively separate sheets by affording three sheet separating actions to an abutment member which is flexed when the sheets are urged against the abutment member.

To achieve the above object, according to the present invention, there is provided a sheet supply apparatus comprising a sheet supporting means for supporting a plurality of sheets, a sheet supply means for feeding out the sheets supported by the sheet supporting means, and a separation means having a separation member which can be elastically flexed to change an inclination angle thereof when the separation member is urged by a sheet fed out by the sheet supply means, thereby separating the sheet which rides over the separation member from the other sheets, and wherein the separation member is disposed in an inclined condition so that a tip end of an abutment surface, against which the sheets are to be urged and over which the sheet rides, of the separation member before flexed is inclined with respect to a normal plane perpendicular to a sheet feeding direction by a predetermined angle toward the sheet supporting means.

Preferably, the above-mentioned predetermined angle of the separation member with respect; to the normal plane is set to 5°–35°.

Preferably, the separation member is a thin plate-shaped member which can be elastically deformed when the sheet urges and rides over the separation member.

Preferably, a notch having a configuration gradually opened from an inside to a tip end of the plate-shaped member over which the sheet rides is formed in the plate-shaped member.

Preferably, a width of the plate-shaped member is gradually reduced from the tip end to a base end at which the separation means is secured.

Preferably, there is provided a fulcrum means for changing a position of a fulcrum around which the separation member is flexed in a flexing direction.

Preferably, the fulcrum means has at least a first fulcrum portion around which the plate-shaped member is firstly flexed, and a second fulcrum portion against which the plate-shaped member is urged when the inclination angle of said separation member increased.

With the arrangement as mentioned above, since the separation means is disposed in an inclined condition so that a tip end of an abutment surface, against which the sheets are to be urged and over which the sheet rides, of the separation member before flexed is inclined with respect to a normal plane perpendicular to a sheet feeding direction by a predetermined angle toward the sheet supporting means, when the separation means is flexed by the sheets, while the separation means is being elastically deformed up to the normal plane, a tip end of the sheet to be separated is separated from a tip end of a second sheet, and a force for separating the sheet to be separated from the second, third and other sheets is applied to the second, third and other sheets (first separating action). Since the tip ends of the sheets are separated from each other in this way, the sheet is further shifted along the separation means being flexed, with the result that the sheet can positively be separated from the second sheet by riding over the tip end of the separation means (second separating action).

By providing the notch having a configuration gradually opened from the inside to the tip end of the separation member over which the sheet rides at the central portion of the separation member, the separating ability is further improved by slidingly contacting the tip end of the sheet with the edges of the notch (third separating action).

Further, by providing a plurality of fulcrum portions around which the plate-shaped member is flexed, various sheets from a sheet having high rigidity to a sheet having low rigidity can positively be separated.

DETAILED DESCRIPTION OF THE PREFERRED EMBODIMENTS

Figure 1:
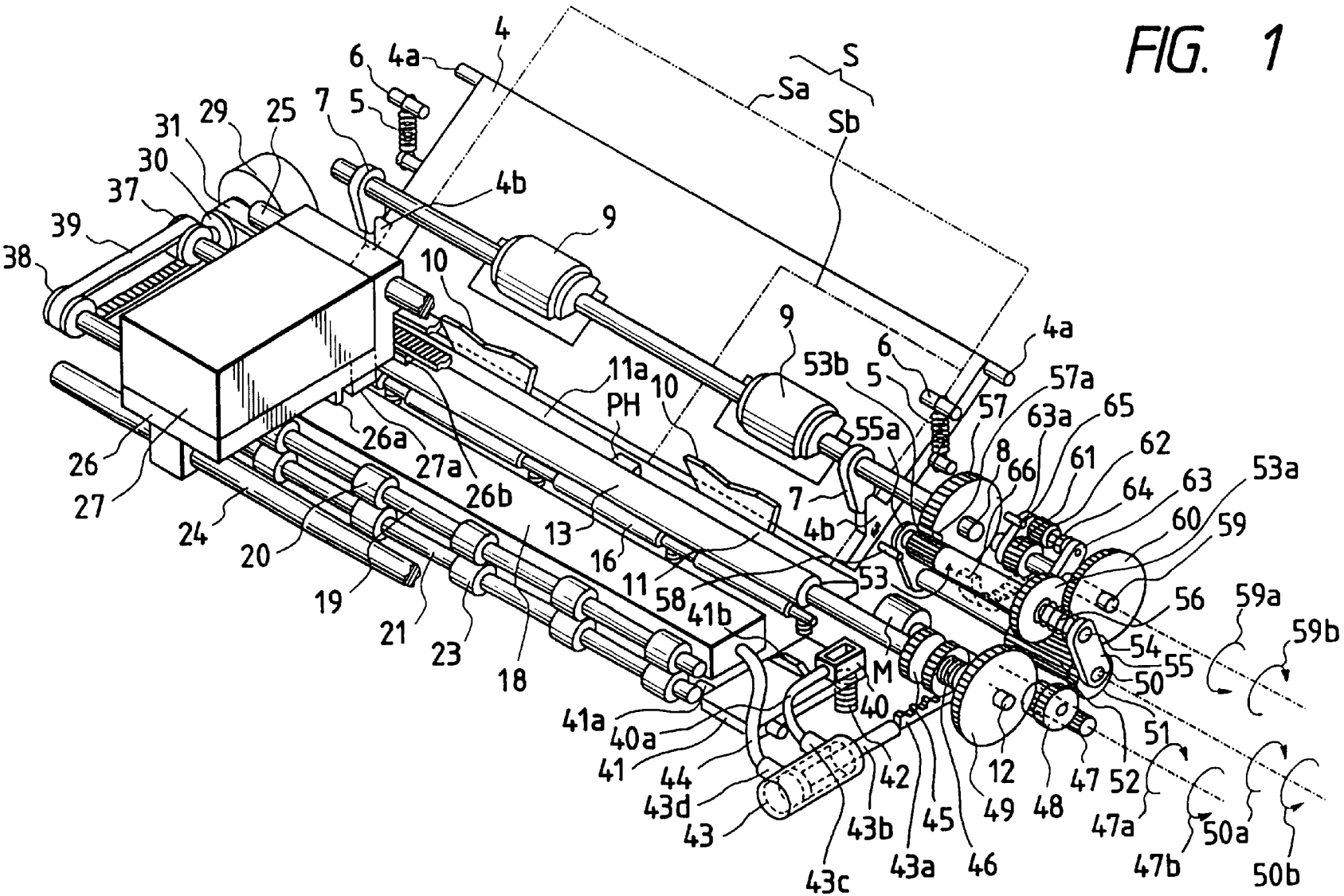
FIG. 1 is a perspective view of a recording apparatus having a sheet supply apparatus according to a first embodiment of the present invention.
Figure 2:
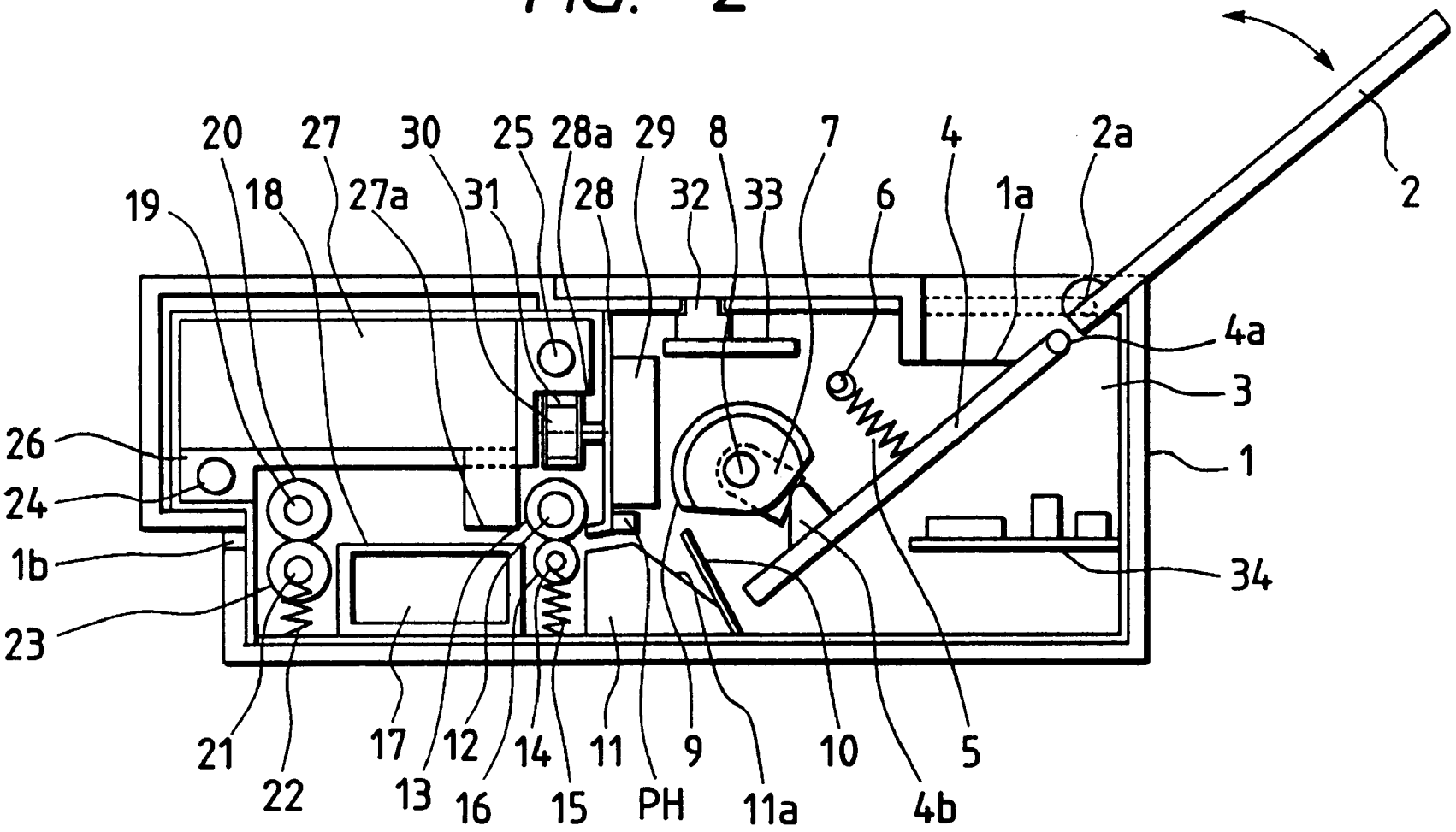
FIG. 2 is an elevational sectional view of the recording apparatus.

FIGS. 1 and 2 show a first embodiment of the present invention which is applied to an ink jet printer having an ink jet recording means, where FIG. 1 is a schematic perspective view of the printer, and FIG. 2 is sectional view of the printer.

In FIG. 2, the printer has a cover 1, and a lid 2 pivotally mounted on a shaft 2*a* and also acting as a sheet tray. Sheets are inserted through an insertion opening 1*a* formed in the cover 1 and are discharged from a discharge opening 1*b*. Within a plurality of side plates 3 provided on the cover 1, there are provided a sheet stacking plate (sheet stacking means) 4 pivotally mounted on a shaft 4*a* and biased (upwardly) toward a sheet supply roller 9 by a spring 5 having one end connected to a pin 5, sheet supply rollers (sheet supply means) 9 each having a large diameter portion capable of being contacted with the sheet and a small diameter portion not contacted with the sheet, drive cams 7 secured to a shaft 8 and engaged by cam follower portions 4*b* provided on left and right ends of the sheet stacking plate 4 to push the sheet stacking plate 4 downwardly, abutment members (separation means) 10 acting as separation members for separating the sheets one by one when it is flexed by the sheets supplied by the sheet supply rollers 9, and a guide member 11 having a surface 11*a* for lifting a tip end of the sheet separated by the abutment members 10 and adapted to separate the sheet from the tip ends of the abutment members 10 by lifting the sheet by the surface 11*a*.

Further, at a downstream side of the guide member 11, there are provided a photo-sensor (sheet detection means) PH having a light emitting portion and a light receiving portion and adapted to detect the tip and rear ends of the sheet on the basis of the presence/absence of the light, a convey roller (convey means) 13 secured to a shaft 12 and adapted to convey the sheet supplied by the sheet supply rollers 9 and guided by an upper guide 28*a* and the guide member 11 at a constant speed, first pinch rollers 16 rotatably mounted on a shaft 14 and urged against the convey roller 13 by springs 15 via the shaft 14, a platen 18 including ink absorbing material 17 therein, discharge rollers 20 secured to a shaft 19 and adapted to discharge the sheet on which an image was recorded, second pinch rollers 23 rotatably mounted on a shaft 21 and urged against the discharge rollers 20 by springs 22 via the shaft 21, a carriage 26 guided by guide shafts 24, 25 and shiftable in a widthwise direction of the sheet, and a recording head 27 mounted on the carriage 26 and adapted to discharge ink from a discharge portion 27*a* to record the image on the sheet in response to image information. The carriage 26 is driven by a motor 29 provided on a central side plate 28 having the upper guide 28*a*, a pulley 30 secured to an output shaft of the motor 29, and a belt 31 mounted around the pulley 30 and having one end secured to the carriage 26.

Further, within the case 1, there are provided an electric operation substrate 33 having a plurality of switch buttons 32 protruded from holes formed in the case 1, and an electric control substrate (control means) 34 disposed below the sheet stacking plate 4 and having a micro-computer and memories to control the operation of the ink jet printer.

Next, a switching means for engaging the sheets stacked on the sheet stacking plate 4 and the sheet supply rollers 9 or disengaging the sheets from the sheet supply rollers 9 will be explained with reference to FIG. 1.

The drive cams (cam members) 7 secured to the shaft 8 of the sheet supply rollers 9 are urged against the corresponding cam follower portions 4*b* provided on the sheet stacking plate 4 at predetermined positions by the springs 5 so that the cams 7 are rotated in synchronous with the sheet supplying operation of the sheet supply rollers 9 to lift or lower the sheet stacking plate 4, thereby engaging the sheets by the sheet supply rollers 9 or disengaging the sheets from the sheet supply rollers.

Since a pulley 37 provided on one end of the shaft 12 of the convey roller is connected to a pulley 38 provided on one end of the shaft 19 of the discharge rollers via a belt 39, a rotational force of a motor (drive source) M is transmitted to the discharge rollers 20 via the shaft 12.

A cap support 41 having a cap 40 for covering the ink discharge portion 27*a* of the recording head 27 is disposed at an opposite side of the motor with the interposition of the sheet conveying path. The cap support 41 has a rotary shaft 41*a* and a push-down cam portion 41*b* and is biased to be rotated around the shaft 41*a* in an anti-clockwise direction by a spring force of a spring 42. As the carriage 26 is shifted, when a projection 26*a* of the carriage 26 is contacted with the push-down cam portion 41*b*, the cap support 41 is pushed downwardly in opposition to the force of the spring 42, thereby lowering the cap 40. After the projection 26*a* passes through the push-down cam portion 41*b*, the cap 40 is lifted to closely cover the ink discharge portion 27*a*.

A pump 43 has a piston shaft 43*b* having a rack 43*a*, a suction port 43*c* and a discharge port 43*d*. The suction port 43*c* is connected to the cap 40 through a tube 40*a*, and the discharge port 43*d* is connected to the platen 18 through a tube 44 so that the ink sucked from the cap 40 is discharged onto the ink absorbing material 17.

A pump drive gear 45 with which the rack 43*a* of the pump 43 can be engaged is mounted on the shaft 12 in such a manner that it can be shifted along the shaft 12 and be rotated together with the shaft 12. The pump drive gear is biased toward a position where the gear is not engaged by the rack 43*a*, by a spring 46.

A solid component of the ink is apt to adhere to the neighborhood of the ink discharge openings to cause the poor ink discharge. If the poor ink discharge occurs, in order to perform a poor discharge recovery operation, under the control of the controller 34, the carriage 26 is shifted by the motor 29 to contact the discharge portion 27*a* with the cap 40. When the carriage 26 is shifted, since the projection 26*b* of the carriage 26 shifts the pump drive gear 45 to a position shown by the two-dot and chain line, the pump drive gear 45 is meshed with the rack 43*a*. In this condition, when the gear 45 is rotated by the motor M within a predetermined rotational angle in the normal and reverse directions alternately by a predetermined number of cycles, the rack 43*a* is reciprocally shifted along a straight line by the same predetermined number of cycles. Since the reciprocal movement of the rack 43*a* causes reciprocal movement of a piston connected to the piston shaft 43*b*, the pump 43 absorbs or sucks the ink and its solid component from the ink discharge portion 27*a*, and the absorbed matters are discharged onto the ink absorbing material 17 in the platen 18.

Next, a drive transmitting mechanism for transmitting the rotational force of the motor M to the sheet supply rollers 9 and the convey roller 13 will be explained.

Under the control of the controller 34, the motor M rotates the pair of convey rollers 13, 16 through an output gear 47 mounted on the output shaft, a two-stage gear 48 and a convey roller gear 49 secured to the shaft 12, thereby conveying the sheet. On the other hand, the motor M also rotates a gear 51 secured to a shaft 50 through the output gear 47 and the two-stage gear 48. A first planetary gear 53 meshed with a first sun gear 52 secured to the shaft 50 comprises a large planetary gear 53*a* and a small planetary gear 53*b*, and a shaft 54 of the first planetary gear 53 is supported by a first carrier 55 which is rotated around the shaft 50.

Since the first planetary gear 53 is urged against one of arm members 55*a* of the first carrier with a predetermined pressure by a spring 56 mounted around the shaft 54, when the first planetary gear 53 is rotated, a certain load is applied to the first planetary gear.

Figure 3:
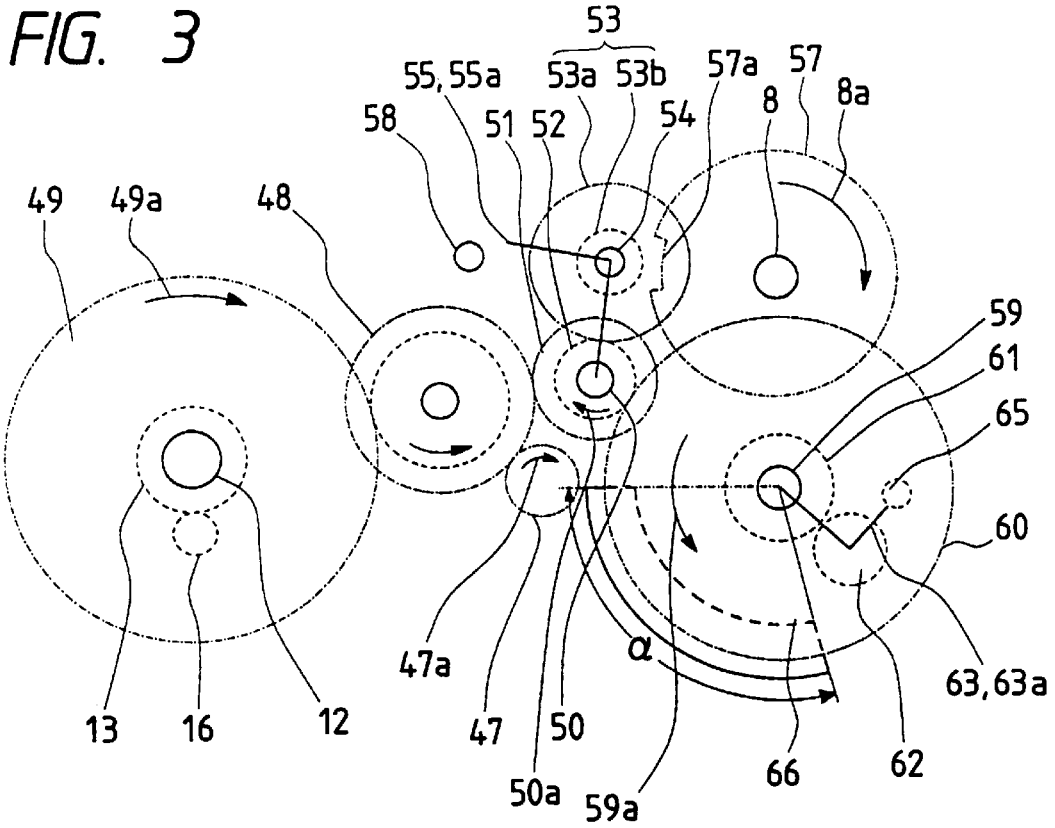
FIG. 3 is an explanatory view showing a normal rotation condition in a drive transmission mechanism of the sheet supply apparatus.

In FIGS. 1 and 3, when the output gear 47 provided on the shaft of the motor M is rotated in a direction shown by the arrow 47*a*, the first sun gear 52 is rotated in a direction shown by the arrow 50*a*. When the large planetary gear 53*a* meshed with the first sun gear 52 is rotated, since a certain load is applied to the large planetary gear, the first planetary gear 53 is not rotated, but is revolved around the first sun gear 52 in a direction shown by the arrow 50*a*. Due to this revolution, since the first carrier 55 is also rotated in the direction shown by the arrow 50*a*, the small planetary gear 53*b* is engaged by a gear 57 secured to the shaft 8 of the sheet supply rollers, with the result that the rotational force of the motor M is transmitted to shaft 8, thereby rotating the sheet supply rollers 9 in a sheet supplying direction 8*a*.

The gear 57 has a non-toothed portion 57*a*. As the gear 57 is rotated, when the non-toothed portion 57*a* is opposed to the small planetary gear 53*b*, the small planetary gear 53*b* is rotated idly, with the result that the rotational force is not transmitted to the gear 57. Consequently, the gear is stopped and the rotation of the sheet supply rollers 9 in the sheet supplying direction 8*a* is also stopped.

Figure 4:
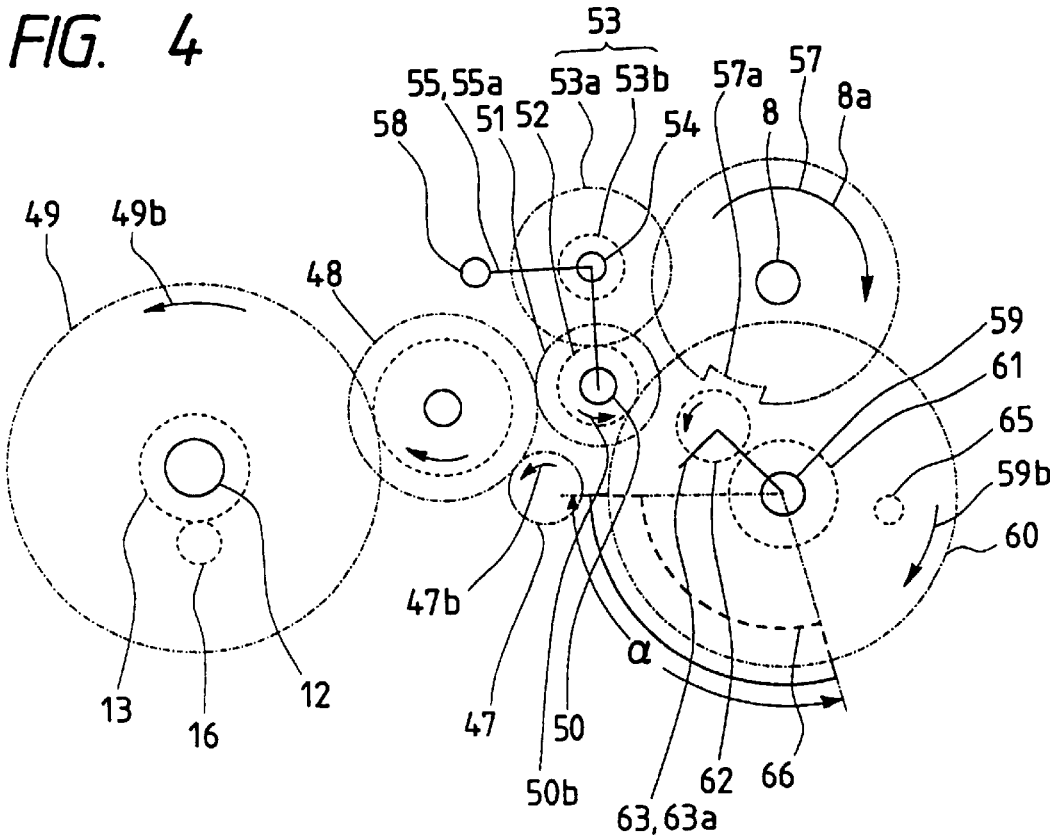
FIG. 4 is an explanatory view showing a reverse rotation condition in the drive transmission mechanism of the sheet supply apparatus.

In FIGS. 1 and 4, when the motor M is rotated in a direction shown by the arrow 47*b*, the first sun gear 52 is rotated in a direction shown by the arrow 50*b*. By this rotation, the first carrier 55 and its arm portions 55*a* are rotated together with the first planetary gear 53 in the direction shown by the arrow 50*b*. When the first carrier 55 is rotated in the direction 50*b*, the small planetary gear 53*b* is disengaged from the gear 57. As a result, one of the arm portions 55*a* is contacted with a pin 58, thereby stopping the first carrier 55. In a condition that the first carrier 55 is stopped, the small planetary gear 53*b* is rotated idly during the rotation of the first sun gear 52 in the direction 50*b*.

A gear 60 meshed with the first sun gear 52 and a second sun gear 61 are secured to a shaft 59. A second planetary gear 62 meshed with the second sun gear 61 is supported by a second carrier 63 which can freely be rotated around the shaft 59. Since the second planetary gear 62 is urged against one of arm members 63*a* of the second carrier with a predetermined pressure by a spring 64, when the second planetary gear 62 is rotated, a certain load is applied to the second planetary gear.

In FIGS. 1 and 3, when the motor M is rotated in the direction 47*a*, the gear 60, shaft 59 and second sun gear 61 are rotated in a direction shown by the arrow 59*a*. As a result, the second carrier 63 is also rotated together with the second planetary gear 62 in the direction 59*a* until the arm member 63*a* of the second carrier is contacted with a pin 65. In the condition that the second carrier 63 is stopped, the further rotation of the sun gear 61 causes idle rotation of the second planetary gear 62.

In FIGS. 1 and 4, when the motor M is rotated in the direction 47*b*, the sun gear 61 is rotated in a direction shown by the arrow 59*b*. As a result, the second carrier 63 is rotated together with the second planetary gear 62 in the direction 59*b*, with the result that the second planetary gear 62 is engaged by the notched gear 57. In this way, the rotation of the second sun gear 61 in the direction 59*b* is transmitted to the shaft 8, thereby rotating the sheet supply rollers 9 in the sheet supplying direction 8*a*.

As the gear 57 is further rotated by the second planetary gear 62, when the non-toothed portion 57*a* of the gear 57 is opposed to the second planetary gear 62, the second planetary gear 62 is idly rotated not to transmit the rotational force to the gear 57. Within a predetermined angle range $\alpha$ of a so-called non-synchronous zone in which the second planetary gear 62 is not engaged with the notched gear 57 while the second planetary gear 62 being completely revolved around the second sun gear 61, the second planetary gear 62 is engaged with an inner gear 66. Due to this engagement, the second planetary gear 62 is revolved around the second sun gear 61 while being rotated.

In FIG. 1, when the pump 43 is operated by the alternate normal and reverse rotations of the motor M by the predetermined amount, in order to prevent the engagement between the gear 57 and the second planetary gear 62, the above-mentioned non-synchronous zone is used.

In the illustrated embodiment, when the motor M is rotated by a predetermined amount to effect the above operation, the non-synchronous zone of 360° is required. However, if the second planetary gear 62 is revolved without rotation, it is impossible to provide the non-synchronous zone of 360°.

Thus, by providing the inner gear 66, the second planetary gear 62 can be rotated and the revolving speed of the second planetary gear can be reduced. In this way, it is possible to set the non-synchronous zone. Now, this will be explained. When it is assumed that the number of teeth of the second sun gear 61 is $Z_1$, the number of teeth of the second planetary gear 62 is $Z_2$ and the number of teeth of the inner gear 66 is $Z_3$, the following relation is established:

$$Z_3=Z_1+2Z_2$$

Accordingly, the reduction ratio between the tooth number $Z_1$ and the tooth number $Z_3$ becomes as follows:

$$Z_1/Z_3=1/1+2(Z_2/Z_1).$$

That is to say, when the second sun gear 61 is rotated within the angular range $\alpha$ of the toothed inner gear 66, the second planetary gear 62 is revolved by $\alpha/1+2(Z_1/Z_2)$, thereby greatly reducing the revolving speed. For example, when $\alpha=120°$, $Z_1=10$ and $Z_2=10$, a revolving angle $\beta$ of the second planetary gear 62 becomes as follows:

$$\beta=120°/3=40°.$$

On the other hand, in order to revolve the second planetary gear 62 by 120°, the second sun gear 61 is rotated by 360° (=120°×3), and, thus, the required non-synchronous zone can be set to 120°.

Next, the sheet supplying operation and recording operation according to the first embodiment will be explained with reference to FIGS. 1 to 4 and FIGS. 5 to 10.

First, of all, to perform an initializing operation, when the power source is turned ON, in response to initialization command from the controller 34 of FIG. 2, the motor M of FIG. 1 is rotated in the direction 47*a* (i.e., the convey roller 13 is rotated to convey the sheet toward the discharge opening 16) by a predetermined amount. As a result, the drive transmitting portion reaches a condition that the rotational force of the motor M of FIGS. 3 and 5 is not transmitted to the sheet supply rollers 9, and the sheet supplying portion becomes a condition shown in FIG. 5.

Figure 5:
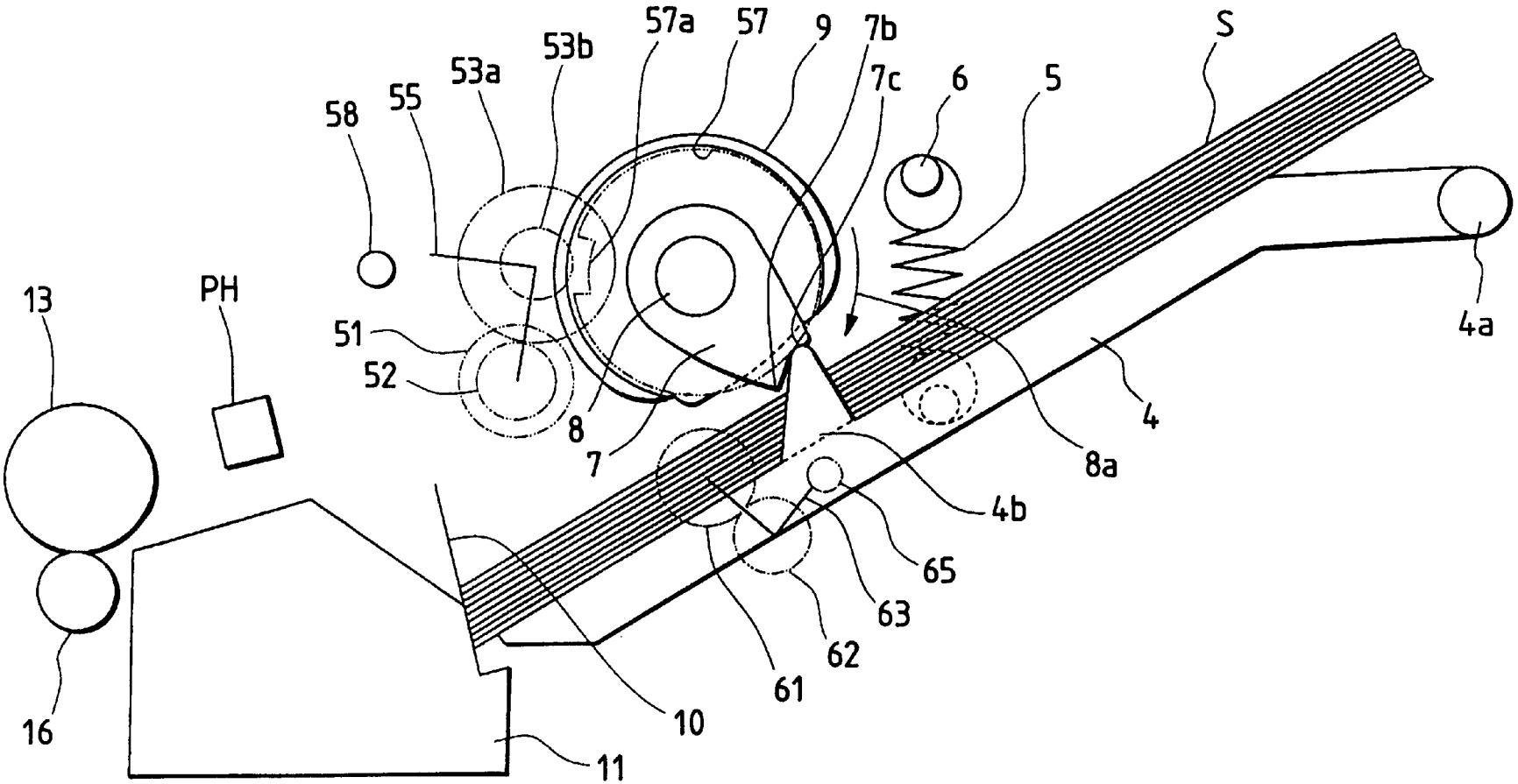
FIG. 5 is a side view of the sheet supply apparatus showing an condition that sheets are not yet separated.

In FIG. 5, in a condition that a stop position lift surface 7*b* of the drive cam 7 is engaged by the cam follower portion 4*b* of the sheet stacking plate 4 by the force of the spring 5, the sheet stacking plate 4 is located at the lowered position. In this condition, a plurality of sheets S are stacked on the sheet stacking plate 4 with tip ends of the sheets contacted with a lower portion of the abutment members 10.

Figure 6:
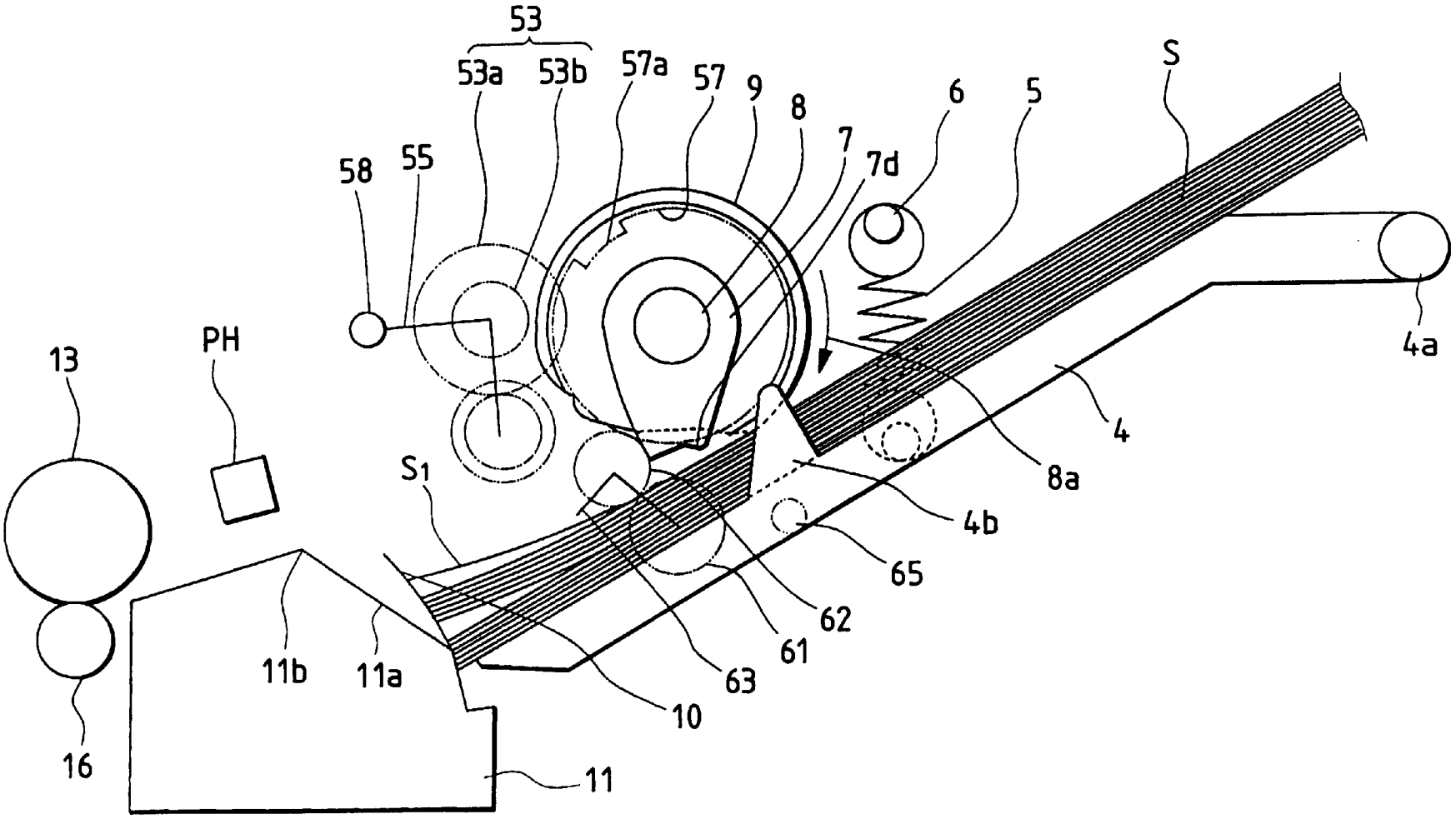
FIG. 6 is a side view of the sheet supply apparatus showing a condition that sheets are being separated.

In FIGS. 4 and 6, when the motor M is rotated in the direction 47*b* by a predetermined amount in response to the sheet supply command, the second planetary gear 62 is revolved from a position when the second carrier 63 is contacted with the pin 65 to a position where the second planetary gear is engaged by the gear 57. When the second planetary gear is engaged by the gear 57, since the rotation of the motor M in the direction 47*b* is transmitted to the gear 57, the sheet supply rollers 9 are rotated in the sheet supplying direction 8*a* via the shaft 8.

On the other hand, when the motor M is rotated in the direction 47*b*, the first planetary gear 53 is rolled around the first sun gear 52 in the direction 50*b* to be disengaged from the gear 57. When the gear 57 is rotated, since the drive cam 7 secured to the shaft 8 is rotated in the direction 8*a*, the stop position lift surface 7*b* of the drive cam 7 is disengaged from the cam follower portion 4*b* of the sheet stacking plate 4, with the result that the sheet stacking plate 4 is lifted by the force of the spring 5.

Consequently, since the uppermost sheet $S_1$ on the sheet stack S rested on the sheet stacking plate 4 is urged against the rotating sheet supply rollers 9, the uppermost sheet $S_1$ is advanced toward the abutment members 10. The abutment members 10 urged by the moving sheets S are flexed in the sheet supplying direction to change their inclination angle.

Figure 7:
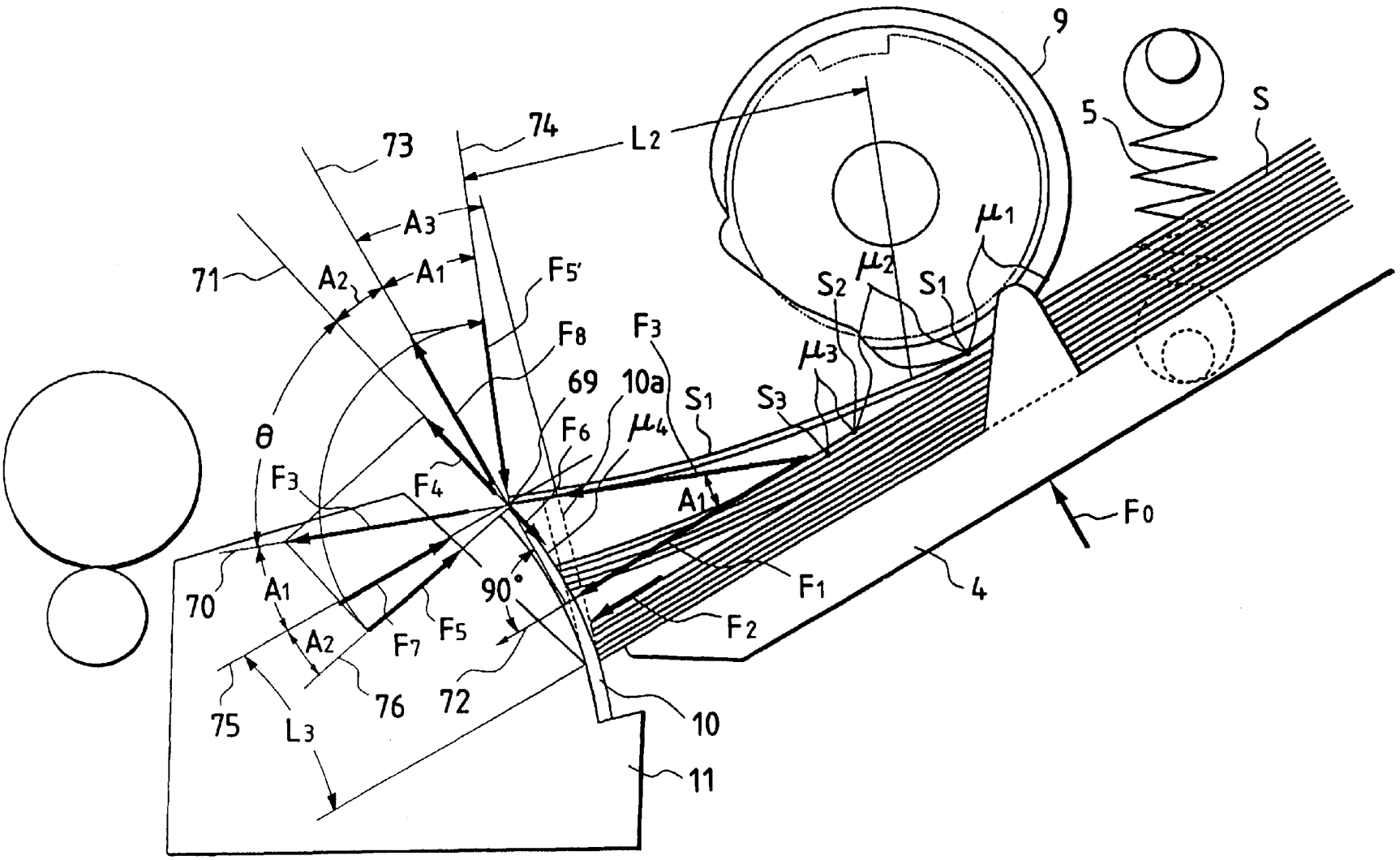
FIG. 7 is a side view showing a relation between forces in the sheet supply apparatus when the sheets are being separated.

FIG. 7 shows a condition that the tip end of the uppermost sheet $S_1$ is aligned with the free ends of the abutment members 10 to establish a balanced state after the sheet supply rollers 9 are further rotated from the position shown in FIG. 6 to further advance the uppermost sheet S1. Two left and right sheet supply rollers 9 are made of material having high coefficient of friction, such as chloroprene rubber, nitrile rubber or silicone rubber, and the sheets stacked on the sheet stacking plate 4 are urged against two sheet supply rollers 9 with an urging force of $F_0$ by the springs 5.

When a coefficient of friction between the sheet supply roller 9 and the uppermost sheet $S_1$ is $\mu_1$, a coefficient of friction between the uppermost sheet $S_1$ and a second sheet $S_2$ is $\mu_2$, a coefficient of friction between the second sheet $S_2$ and a third sheet $S_3$ is $\mu_3$ and so on, a relation between the coefficient $\mu_1$ of friction and the coefficient $\mu_2$ of friction is $\mu_1>>\mu_2$. Accordingly, when the sheets S stacked on the sheet stacking plate 4 are urged against two sheet supply rollers 9 with an urging force of $F_0$ by the springs 5, the uppermost sheet $S_1$ is urged against the abutment members 10 with a shifting force of $F_1$ ($=F_0(\mu_1-\mu_2)$). On the other hand, a shifting force $F_2$ for the second sheet, third sheet and so on is $F_0(\mu_2-\mu_3)$. In this case, since $\mu_2\cong\mu_3$, the shifting force $F_2$ is smaller than the shifting force $F_1$.

Figure 8:
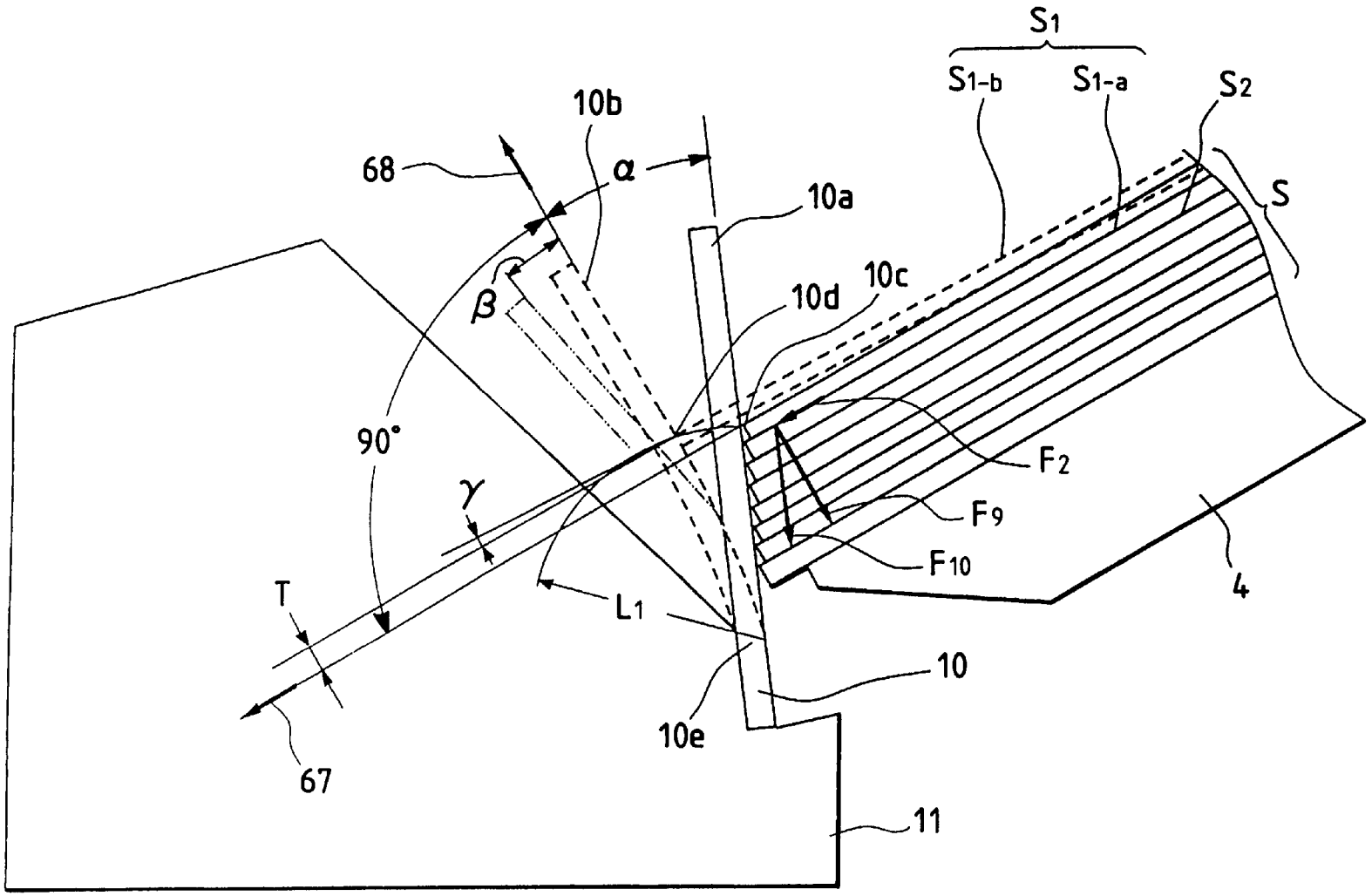
FIG. 8 is a side view showing a relation between forces in the sheet supply apparatus when the separation of the sheets is started.

Now, a first separating action of the abutment member 10 will be explained with reference to FIG. 8.

When the uppermost sheet $S_1$ is in a condition $S_{1-a}$, the abutment member 10 is secured, at its bottom end, to the guide member 11 in a condition 10*a* where the abutment member 10 is inclined toward the sheet supply roller 9 by an angle $\alpha$ with respect to a line 68 perpendicular to a sheet supplying direction 67.

The uppermost sheet $S_1$ is urged against the abutment member 10*a* at a point 10*c*. When the abutment member 10 is flexed by the above-mentioned force $F_1$ by the angle $\alpha$ to be shifted from the condition 10*a* to a condition 10*b*, the uppermost sheet $S_1$ is shifted from the condition $S_{1-a}$ to a condition $S_{1-b}$. When a distance between the point 10*c* on the abutment member 10*a* and a point 10*e* on the abutment member 10 is $L_1$ and a changed amount from the point 10*c* to a point 10*d* on the abutment member 10*b* (corresponding to the point 10*c*) in the vertical direction 68 is T, a relation $T=L_1(1-\cos\alpha)$ is obtained. On the other hand, force components $F_9$, $F_{10}$ of the shifting force $F_2$ acting on the second, third and other sheets $S_2$, $S_3$, . . . serve to urge the tip ends of the sheets $S_2$ and the like against the surface of the sheet stacking plate 4.

Regarding the tip ends of the uppermost sheet $S_1$ and the second sheet $S_2$ and the like, the tip end of the uppermost sheet $S_1$ is separated from the tip end of the second sheet $S_2$ (urged against the sheet stacking plate 4) by the amount T. This separation is referred to as "first separating action".

The first separating action gives the following excellent advantages. The first advantage will now be described. It is assumed that the abutment member 10 is fixed at the position 10*b* along the vertical direction 68 and the tip end of the sheet $S_1$ starts to be slid (from the condition $S_{1-a}$) on the abutment member 10 when the abutment member is flexed from the position 10*b* by the inclination angle $\beta$. In this case, the inclination angle (of the abutment member) that the tip end of the sheet $S_1$ starts to be slid (from the condition $S_{1-b}$) on the abutment member when the abutment member 10 is flexed from the position 10*a* becomes $(\beta-\gamma)$, which is smaller than the inclination angle $\beta$ when the abutment member is flexed from the position 10*b*. When the uppermost sheet $S_1$ starts to be slid on the abutment member 10 at the value $(\beta-\gamma)$, since the inclination angles of portions of the abutment member against which the second, third and other sheets $S_2$, $S_3$, . . . are urged are smaller than the value ($\beta-\gamma$), the second, third and other sheets $S_2$, $S_3$, . . . does not slide on the abutment member.

Further, the second, third and other sheets $S_2$, $S_3$, . . . are urged against the abutment member 10 with the shifting force $F_2$ smaller than the shifting force $F_1$ for the uppermost sheet $S_1$. While the abutment member 10 is being flexed by the inclination angle $\alpha$ by the shifting force $F_1$ of the first sheet $S_1$, since the force components $F_9$, $F_{10}$ act on the second, third and other sheets $S_2$, $S_3$, . . . to prevent the first separating action of the second, third and other sheets $S_2$, $S_3$, . . . , it is possible to prevent the second, third and other sheets $S_2$, $S_3$, from being separated together with the first sheet $S_1$, thereby surely preventing the double-feed of sheets.

The first separating action is particularly effective to a thin sheet having weak resiliency (for example, a sheet having a thickness of about 0.065 mm). Although the magnitude of the angle a generating the first separating action is varied with a length $L_1$ of the abutment member 10, the bending elastic module of material of the abutment member 10 and the like, it was found, from the result of tests, that the angle $\alpha$ is preferably 5° to 35°.

Next, the second advantage of the first separating action will be described. After the supplying of the first sheet $S_1$ is completed, when the sheet stacking plate 4 is lowered to separate the sheets from the sheet supply rollers, since a force of the abutment member 10 acting on the second, third and other sheets $S_2$, $S_3$, . . . to return the sheets S to the set position of FIG. 5 is stronger at the position 10*a* (near the sheet supply rollers 9) than at the position 10*b*, the second, third and other sheets $S_2$, $S_3$, . . . can surely be returned by the abutment member 10.

In FIG. 7, the abutment member 10 is flexed from the position 10*a* by an inclination angle of ($A_2+A_3$) by a force $F_3$ (=$F_1 \cos A_1$) of the uppermost sheet $S_1$. At this point, the tip of the sheet $S_1$ and the tip end of the abutment member 10 are elastically balanced with each other at a point 69 and the sheet $S_1$ is stopped.

When the force of the sheet $S_1$ urging the abutment member 10 is $F_3$, a coefficient of friction between the tip end of the sheet $S_1$ and the abutment member 10 is $\mu_4$, and an angle between a tangential line 70 of the sheet $S_1$ at the point 69 and a tangential line 71 of the abutment member 10 at the point 69 is θ°, $$F_4=F_3 \cos \theta^\circ$$

$$F_5=F_3 \sin \theta^\circ$$

$$F_6=\mu_4 F_3 \sin \theta^\circ \quad (1)$$

and, accordingly, $$(F_4-F_6)>0$$

$$F_3(1-\mu_4 \tan \theta^\circ)>0$$

$$\theta^\circ>\tan^{-1}1/\mu_4 \quad (2)$$

Thus, the sheet $S_1$ starts to be slid on the abutment member 10 at the above-identified angle θ°.

When an angle between a line 73 perpendicular to the sheet supplying direction and passing through the point 69 and a line 74 perpendicular to the tangential line 70 at the point 69 is $A_1$ [rad], the sheet $S_1$ is flexed under the following condition:

$$A_1 \cong F_9 L_2^2 K_1 \quad (3)$$

$$K_1=\tfrac{1}{2}\times E_1\times I_1 \quad (3)'$$

where, $K_1$=elasticity of sheet $S_1$, $A_1$=slope or deflection of sheet $S_1$ [rad], $L_2$=deflection length of sheet $S_1$, $E_1$=Young's modulus of sheet $S_1$, $I_1$=geometrical moment of inertia of sheet $S_1$.

And, due to the above balance, the following relation is established:

$$F_5'=F_5=F_8 \cos A_{1^\circ} \quad (4)$$

(where, $A_1{}^\circ=A_1\times 180^\circ/\pi$).

Further, when an angle between the line 73 and the tangential line 71 is $A_2$ [rad], the abutment member 10 is flexed under the following condition:

$$A_2 \cong F_7 L_3^2 K_2 \quad (5)$$

$$K_2=\tfrac{1}{2}\times E_2\times I_2\times n \quad (5a)$$

where, $K_2$=elasticity of abutment member 10, $A_2$=slope or deflection of abutment member 10 [rad], $L_3$=deflection length of abutment member 10, $E_2$=Young's modulus of abutment member 10, $I_2$=geometrical moment of inertia of abutment member 10, n=number of abutment members 10 (in this example, n=2).

And, due to the above balance, the following relation is established:

$$F_5=F_7 \cos A_2{}^\circ \quad (6)$$

(where, $A_2{}^\circ=A_2\times 180^\circ/\pi$).

On the other hand, from the above relations (1), (4), (6), the force $F_3$ in the balanced condition is determined by the following equation (8) on the basis of a relation $F_3 \sin \theta^\circ=F_8 \cos A_1{}^\circ=F_7 \cos A_2{}^\circ$:

$$F_3=F_8 \cos A_1{}^\circ/\sin \theta^\circ=F_7 \cos A_2{}^\circ/\sin\theta^\circ \quad (8)$$

Accordingly, when the shifting force greater than the force $F_3$ determined by the equation (8) is applied from the sheet supply roller 9 to the sheet $S_1$, the tip end of the sheet $S_1$ rides over the tip end of the abutment member 10 and is completely separated from the second, third and other sheets $S_2$, $S_3$, . . . . This separating operation is referred to as "second separating action".

From the above relation (2), since the angle θ° depends upon only the coefficient $\mu_4$ of friction, the following relation (9) can be derived from the above relation (5):

$$A_1{}^\circ+A_2{}^\circ \cong 90^\circ-\theta^\circ=\text{constant} \quad (9)$$

The value of the elasticity $K_1$ of the sheet $S_1$ included in the above relation (3) is varied with the kind of sheet S. For example, when elasticity of a thin sheet having a thickness of 0.065 mm is $K_{1\text{-}a}$ and elasticity of a post card or an envelope is $K_{1\text{-}b}$, it was found that the following relation (10) is obtained:

$$K_{1\text{-}b}/K_{1\text{-}a} \cong 13 \quad (10)$$

In case of the thin sheet, regarding the angle θ° effecting the second separating action on the basis of the above relation (9), $A_1{}^\circ >> A_2{}^\circ$. That is to say, in the separation of the thin sheet, the slope of the sheet itself greatly contributes to the separation.

On the other hand, regarding the thick sheet such as a post card, $A_1° \leqq A_2°$. That is to say, the slope of the abutment member 10 greatly contributes to the separation. When the separating action is effected, in order to prevent the double-feed of the second, third and other sheets, it is necessary to reduce the value of $A_2°$ in the above equation (9) as much as possible. Although the value $A_1°$ in the above relation (3) is greatly varied with the value $K_1$, since the value of the deflection length $L_2$ of the sheet $S_1$ is varied under square (second power), by appropriately selecting the value $L_2$, the influence of the above relation (10) upon the slope $A_1$ can be reduced.

When the deflection length $L_2$ is increased, since the slope $A_1$ is increased, the thick sheet can easily be separated, but, regarding the thin sheets, the second, third and other sheets may also be flexed to cause the double-feed of sheets. To the contrary, when the deflection length $L_2$ is decreased, since the slope $A_1$ is decreased, the thin sheet can easily be separated, but, the thick sheet is hard to be flexed, with the result that the slope $A_2$ of the abutment member 10 is increased to cause the double-feed of the second, third and other sheets. From the above, it was found, when the elasticity $K_1$ is included within the range of the above relation (10), that the good second separating action can be obtained by setting the deflection length $L_2$ to 15–25 mm.

In FIG. 6, the tip end of the sheet $S_1$ which passed through the tip end of the abutment member 10 is directed upwardly by the inclined surface 11*a* of the guide member 11 to be lifted toward a top 11*b* of the guide member. Then, the tip end of the sheet is shifted toward the nip between the convey roller 13 and the first pinch rollers 16.

Next, the correction of skew-feed of the separated sheet will be explained.

Figure 9:
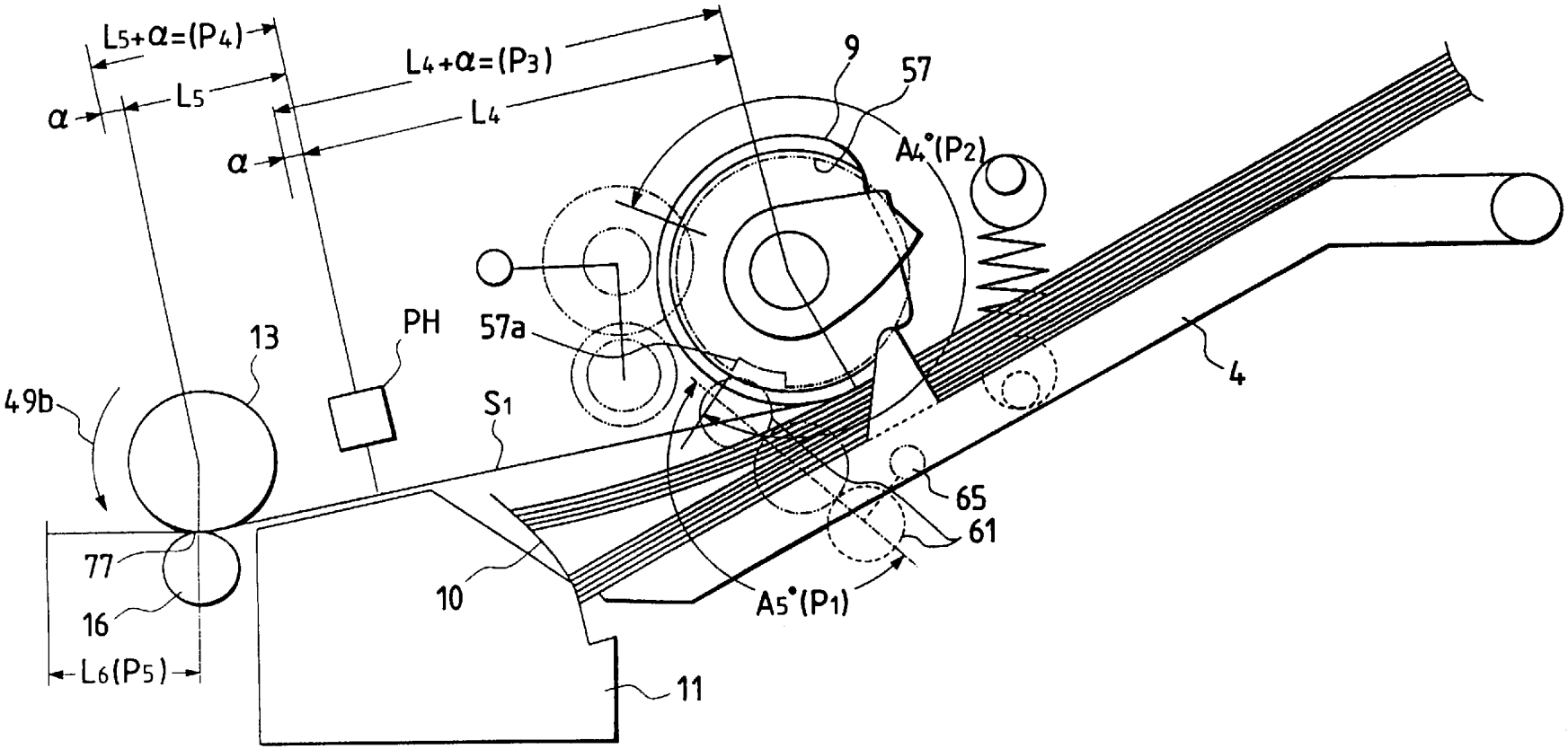
FIG. 9 is a side view of the sheet supply apparatus showing various feeding amounts for the sheets.

In FIG. 9, when the tip end of the separated sheet passes by the photo-sensor PH, the latter emits a signal. In response to this signal, under the control of the controller 34 of FIG. 2, the motor M is rotated by the number $P_4$ of pulses corresponding to a distance of $(L_5+\alpha)$ ($\alpha$=margin=2–5 mm) and then is stopped temporarily. The tip end of the sheet $S_1$ is urged against the nip 77 between the reversely rotating convey roller 13 (in the direction 49*b*) and the first pinch rollers 16 by the sheet supply rollers 9 driven by the number $P_4$ of pulses of the motor, thereby stopping the tip end of the sheet $S_1$.

In the condition that the tip end of the sheet $S_1$ is stopped, if the sheet supply rollers 9 are still being rotated, the sheet supply rollers 9 are rotated while slipping on the sheet $S_1$.

If the sheet $S_1$ is skew-fed, although one of the corners of the tip end of the sheet is firstly contacted with the nip 77 and is stopped there, since the other corner of the tip end of the sheet is still moved, the sheet is turned around the contacted one corner (of the tip end thereof). As a result, the whole length of the tip end of the sheet is aligned with the nip 77, thereby correcting the skew-feed of the sheet.

After the motor is rotated by the number $P_4$ of pulses, the motor M is rotated in the normal direction shown by the arrow 47*a* by the number $P_5$ of pulses corresponding to a convey distance $L_6$ effected by the convey roller 13 (from the condition of FIG. 4 to the condition of FIG. 3). The sheet supply rollers 9 are further rotated by the number $P_5$ of pulses of the motor M, thereby penetrating the tip end of the sheet $S_1$ into the nip 77. The penetrated tip end of the sheet $S_1$ is conveyed by the distance $L_6$ by rotating the convey roller 13 in the direction opposite to the direction 49*b*.

Figure 24:
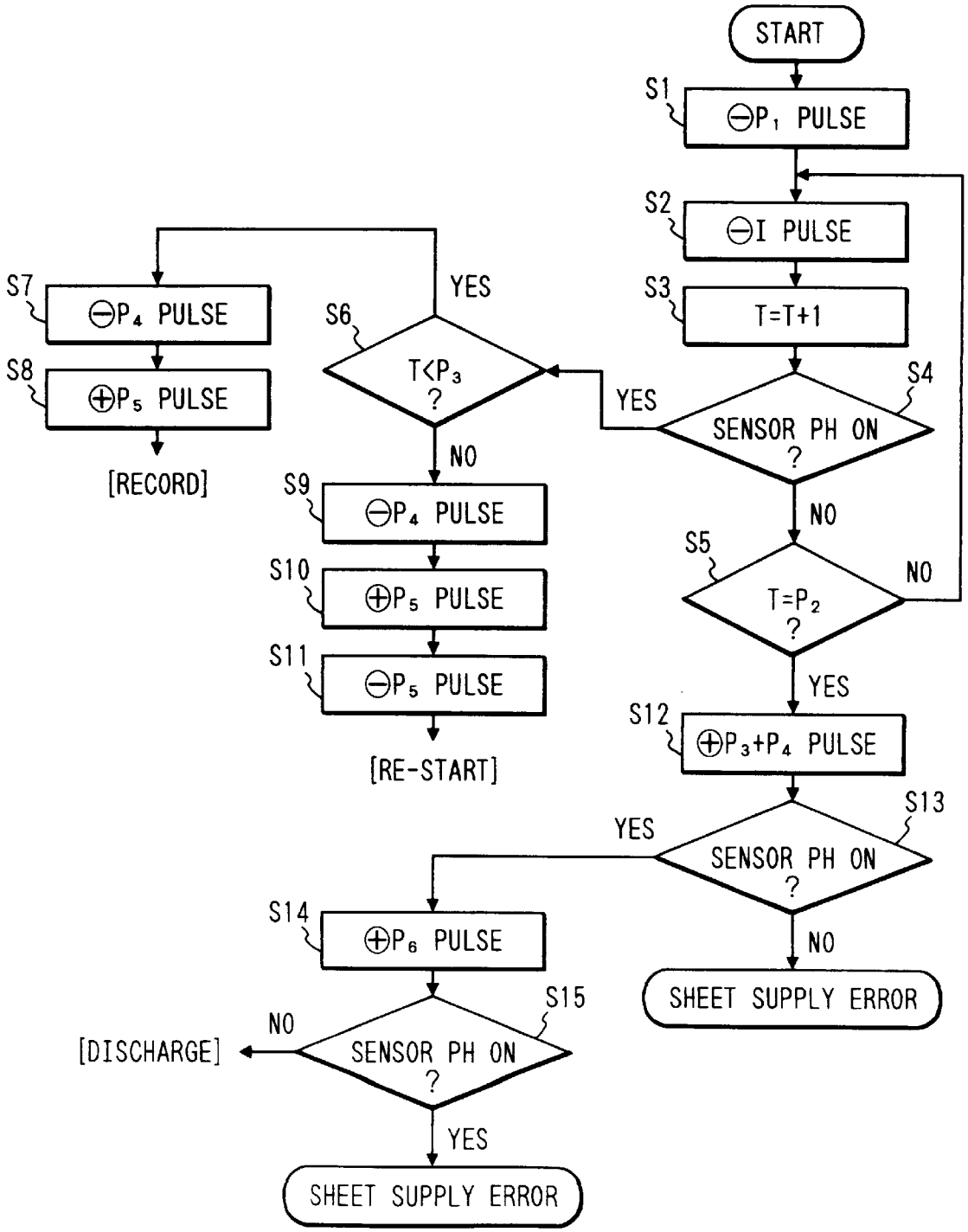
FIG. 24 is a flow chart for explaining a re-tray control in the sheet supply apparatus.

Next, a correction means for correcting poor sheet supply and poor registration of sheet with respect to a recording position will be explained with reference to FIGS. 9 and 24. FIG. 24 is a flow chart showing the operation of the sheet supply apparatus. In FIG. 24, a circled symbol+(plus) indicates the normal rotation (to the direction 47*a*) of the motor M, and a circled symbol−(minus) indicates the reverse rotation (to the direction 47*b*) of the motor M. Incidentally, the motor M (FIG. 1) acting as the drive motor for the sheet supply rollers 9 and the convey roller 13 comprises a pulse drive motor.

In FIGS. 9 and 24, in various steps, the numbers of pulses applied to the motor M are as follows:

$P_1$=number of pulses required for revolve the second planetary gear 61 by an angle $A_5°$;

$P_2$=number of pulses corresponding to an angle $A_4°$ through which the non-toothed portion of the gear 57 is rotated from the position where it is opposed to the first planetary gear 53 to the position where it is opposed to the second planetary gear 61;

$P_3$=number of pulses corresponding to the rotation of the sheet supply roller 9 by a distance $(L_4+\alpha)$ ($\alpha$=2–5 mm);

$P_4$=number of pulses corresponding to the rotation of the sheet supply roller 9 by a distance $(L_5+\alpha)$ ($\alpha$=2–5 mm);

$P_5$=number of pulses corresponding to the rotation of the convey roller 13 by a distance $L_6$; and $P_6$=number of pulses corresponding to a convey distance through which the sheet is conveyed by the convey roller by an amount corresponding to twice of longitudinal length of the maximum available sheet.

Now, the operating sequence for the motor M will be explained with reference to FIG. 24. The motor M rotated at the "start" is stopped at the same time when the second planetary gear 61 is engaged by the gear 57 (step S1). Then, in a loop between a step S2 and a step S5, the motor M is rotated in the reverse direction until a count value T of a counter in a step S3 reaches a value $P_2$. During the reverse rotation of the motor M, when the photo-sensor PH is turned ON in a step S4, in a step S6, the count value T is checked.

In the step S6, if $T<P_3$, the sequence goes to a step S7, where the tip end of the sheet S1 is urged against the nip between the reversely rotating convey roller 13 and the first pinch rollers 16, thereby correcting the skew-feed of the sheet $S_1$. Then, in a step S8, the motor M is rotated in the normal direction to convey the tip end of the sheet $S_1$ to the predetermined recording position $L_6$. Thereafter, the image is recorded on the sheet $S_1$ by the recording operation which will be described later.

On the other hand, in the step S6, if $T>P_3$, even when the operation of the step S7 is effected, the tip end of the sheet $S_1$ does not often reach the nip 77. That is to say, when $P_2=(P_3+P_4)$, if $T>P_3$, since the non-toothed portion 57*a* of the gear 57 is opposed to the second planetary gear 61 as shown in FIG. 4 during the rotation of the motor M by the number $P_4$ of pulses, the sheet supply rollers 9 are stopped so that the sheet supply rollers 9 cannot convey the sheet by an amount smaller than the number $P_4$ of pulses. Such a phenomenon will occur when the sheet supplying force of the sheet supply rollers is reduced due to the low coefficient of friction of the sheet so that the sheet supply rollers convey the sheet while slipping on the sheet.

In the step S6, if it is judged to $T>P_3$, after the tip end of the sheet is penetrated into the nip 77 between the convey roller 13 and the first pinch rollers 16 by effecting the steps S9 and S10, in a step S11, when the convey roller is rotated in the reverse direction by the number $P_5$ of pulses, the sheet $S_1$ is returned toward the sheet supply rollers and the tip end of the sheet $S_1$ is trapped in the proximity of the nip 77. After the step S11 is effected, the step S1 is immediately effected.

In this case, since the photo-sensor PH was already turned ON by the sheet $S_1$, the sequence goes from the step S5 to the step S6. And, in the step S6, since $T<P_3$, the sequence goes to the step S7 and then goes to the step S8. Then, the normal recording operation is effected.

Even when $T=P_2$ in the step S5, if the photo-sensor is not turned ON in the step S4, the sequence goes to a step S12, where the motor M is rotated in the normal direction by an amount corresponding to $(P_3+P_4)$, and, then, in a step S13, it is judged whether the photo-sensor PH is turned ON. In the step S13, if the photo-sensor is not turned ON, it is judged that the sheet is jammed at an upstream side of the photo-sensor PH, and the control mode is changed to a sheet supply error mode.

The controller 34 displays the sheet supply error by using an LED display means or liquid crystal display means provided on the operation electric substrate 33 of FIG. 2 and informs the operator of the error by a buzzer or an alarm. The operator can retract the sheet on the sheet stacking plate 4 on the basis of the error display, and ascertain whether the tip end(s) of the sheet(s) is bent or folded. After the sheet are correctly rested on the sheet stacking plate 4 again, the sheet supplying operation is re-started.

In the step S13, if the photo-sensor PH is turned ON, it is judged that the tip end of the sheet $S_1$ is positioned at a downstream side of the photo-sensor PH. Then, in a step S14, the sheet is discharged completely out of the recording apparatus by conveying the sheet by an amount corresponding to the number $P_6$ of pulses. Then, in a step S15, it is judged whether the sheet is present or absent. If the photo-sensor PH is not turned ON in the step S15, it is judged that the sheet is completely discharged for preparation for the next sheet supply.

To the contrary, in the step S15, if the photo-sensor is turned ON, it is judged that the sheet is jammed at a downstream side of the photo-sensor PH not to be discharged by the rotation of the convey roller, and the control mode is changed to the sheet supply error mode. The operator can retract the sheet on the sheet stacking plate 4 on the basis of the error display, and ascertain whether the tip end(s) of the sheet(s) is bent or folded. After the sheet are correctly rested on the sheet stacking plate 4 again, the sheet supplying operation is re-started.

Next, the conveyance of the sheet $S_1$ after the correction of the skew-feed will be explained.

Figure 10:
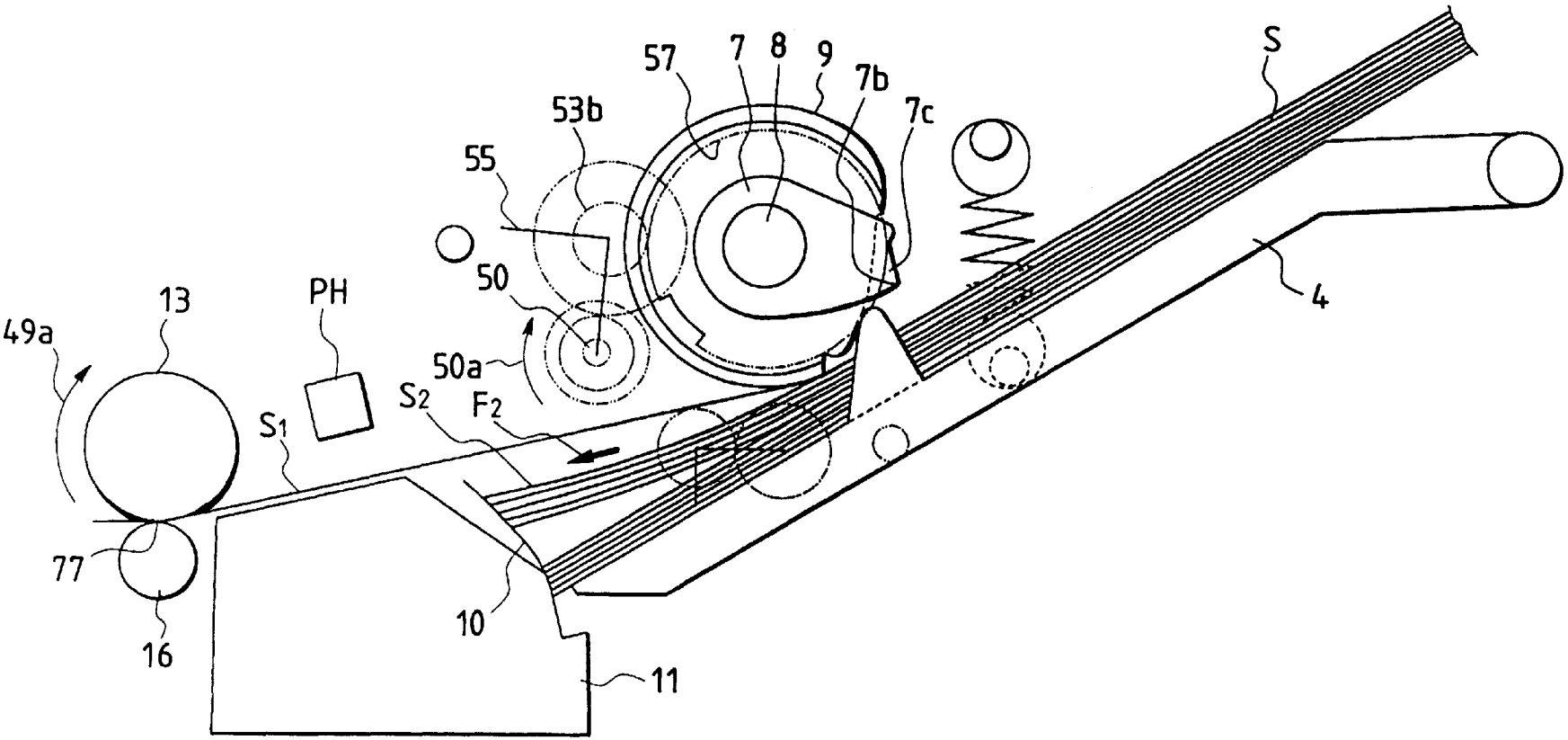
FIG. 10 is a side view of the drive transmission mechanism of the sheet supply apparatus showing a condition when the reverse rotation condition is switched to the normal rotation condition.

On the basis of the total number $P_T$ of pulses of the motor M and in response to the signal from the photo-sensor PH, the controller 34 rotates the output gear 47 of the motor M (FIG. 1) in the direction 47*a*. In FIG. 10, the convey roller 13 is rotated in the direction 49*a* by the rotation of the gear 47. On the other hand, since the carrier 55 is rotated around the shaft 50 in the direction 50*a*, the small planetary gear 53*b* of the first planetary gear 53 is immediately engaged by the gear 57. Due to this engagement, the sheet supply rollers 9 are rotated in the sheet supplying direction to penetrate the tip end of the sheet $S_1$ into the nip 77 between the convey roller 13 and the first pinch rollers 16. The penetrated tip end of the sheet $S_1$ is passed through the nip 77 by the rotation of the convey roller 13.

Since the sheet supply rollers 9 are rotated while urging the sheets S until the sheet $S_1$ is passed through the nip 77, as already explained in connection with FIG. 7, the shifting force $F_2$ smaller than the shifting force $F_1$ acts on the second, third and other sheets $S_2$, $S_3$, . . . . Regarding the inclination angle of the abutment member 10 caused by the shifting force $F_2$, since the angle θ° included in the above relation (2) at a point that the second sheet $S_2$ is contacted with the abutment member 10 satisfies the following relation (11), the tip ends of the second, third and other sheets $S_2$, $S_3$, . . . not slide on the surface of the abutment member, with the result that the tip ends of the sheets do not ride over the tip end of the abutment member:

$$\theta^\circ \geqq \tan^{-1} 1/\mu_4 \tag{11}$$

The gear 57, drive cams 7 and sheet supply rollers 9 are arranged on the shaft 8 in a predetermined fixed phase relation. Further, each drive cam 7 has a drive lift surface 7*a*, a maximum lift surface 7*b*, the stop position lift surface 7*d* having lift smaller than that of the maximum lift surface 7*b*, and an inclined surface 7*c* connecting between the maximum lift surface 7*b* and the stop position lift surface 7*d*.

Due to the rotation of the small planetary gear 53*b* of the first planetary gear 53, the drive cams 7 are rotated in the direction 8*a* via the gear 57 and the shaft 8. During the rotation of the cams, the drive lift surfaces 7*a* of the cams are contacted with the left and right cam follower portions 4*b* of the sheet stacking plate 4 so that the sheet stacking plate 4 is rocked around the shaft 4*a* in opposition to the spring forces of the springs 5, by the rotation of the drive cams 7.

When the sheet stacking plate 4 is lowered, since the upper surface of the sheet stack S rested on the sheet stacking plate is separated from the sheet supply rollers 9, the second, third and other sheets $S_2$, $S_3$, . . . can easily be moved in the direction opposite to the sheet supplying direction, and, thus, the second, third and other sheets $S_2$, $S_3$, . . . are moved in the direction opposite to the sheet supplying direction by the restoring force of the abutment members 10 and, at the same time, are lowered in synchronous with the lowering movement of the sheet stacking plate 4. After the sheets are lowered in this way, since the sheets do not exist on the flexible portion of the abutment members 10, the abutment members 10 can be returned to the initial non-flexed condition. In this way, the load is removed from the abutment members 10.

In a condition (FIG. 11) that the upper surface of the sheet stack rested on the sheet stacking plate is separated from the sheet supply rollers, the sheet $S_1$ is prevented for depending down from the predetermined position by providing the top 11*b* of the guide member 11. That is to say, the position of the top 11*b* and the position of the tip end of the abutment member 10 are selected so that a predetermined gap 78 is created between the lower surface of the regulated sheet $S_1$ and the tip end of the abutment member 10. By providing such a gap 78, while the abutment member is being restored to its non-flexed condition, since the tip end of the abutment member 10 does not interface with the sheet $S_1$, the restoring movement of the abutment member can surely be achieved. Further, by providing the gap 78, since the sheet $S_1$ does not contact with the tip end of the abutment member 10, the occurrence of noise can be prevented.

Incidentally, in the sheet supply roller 9 having the large diameter portion and the small diameter portion, the sheets are fed out by contacting the large diameter portion made of high friction material such as rubber with the sheet stack and by rotating the roller, and, after the sheets are fed out, the small diameter portion is opposed to the sheet stack. Since the small diameter portion has a protruded flange 9*a* made of low friction material and the high friction surface is retarded, after the convey roller 13 starts to convey the sheet fed out by the sheet supply rollers, when the small diameter portion is opposed to the sheet stack, the flexed amount of the sheets reduced by an amount corresponding to the difference in radius between the large diameter portion and the small diameter portion, and, at the same time, the flange 9*a* is contacted with upper surface of the sheet being conveyed, thereby guiding the conveyance of the sheet while preventing the sheet from floating. In this case, since the flange 9*a* is made of low friction material, the resistance to the conveyance of the sheet is reduced, and, thus, the fluctuation in load acting on the motor (drive source) 13 for the convey roller 13 is also reduced, thereby improving the conveying accuracy of the convey roller 13.

Figure 11:
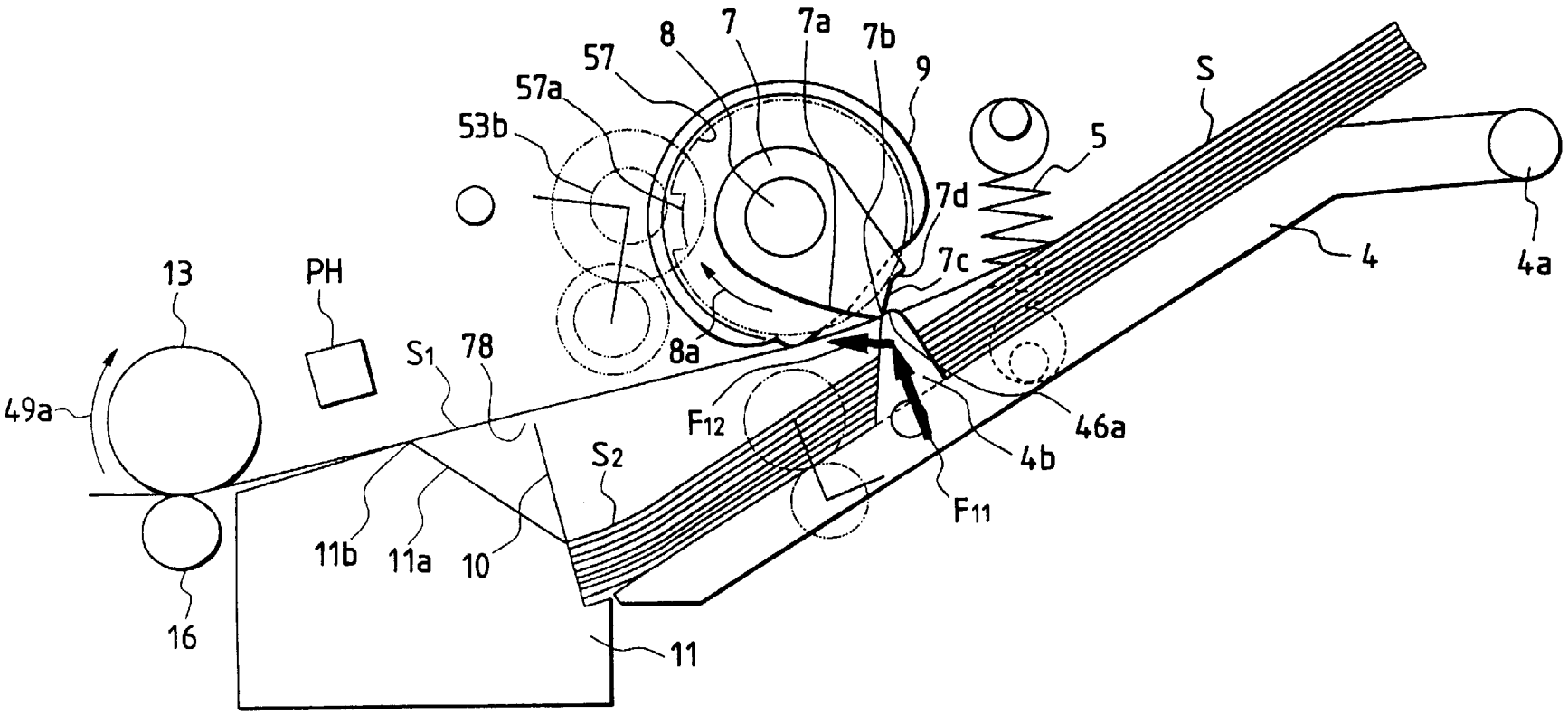
FIG. 11 is a side view of the sheet supply apparatus showing a condition when the separation between a sheet supply roller and the sheet is started.
Figure 12:
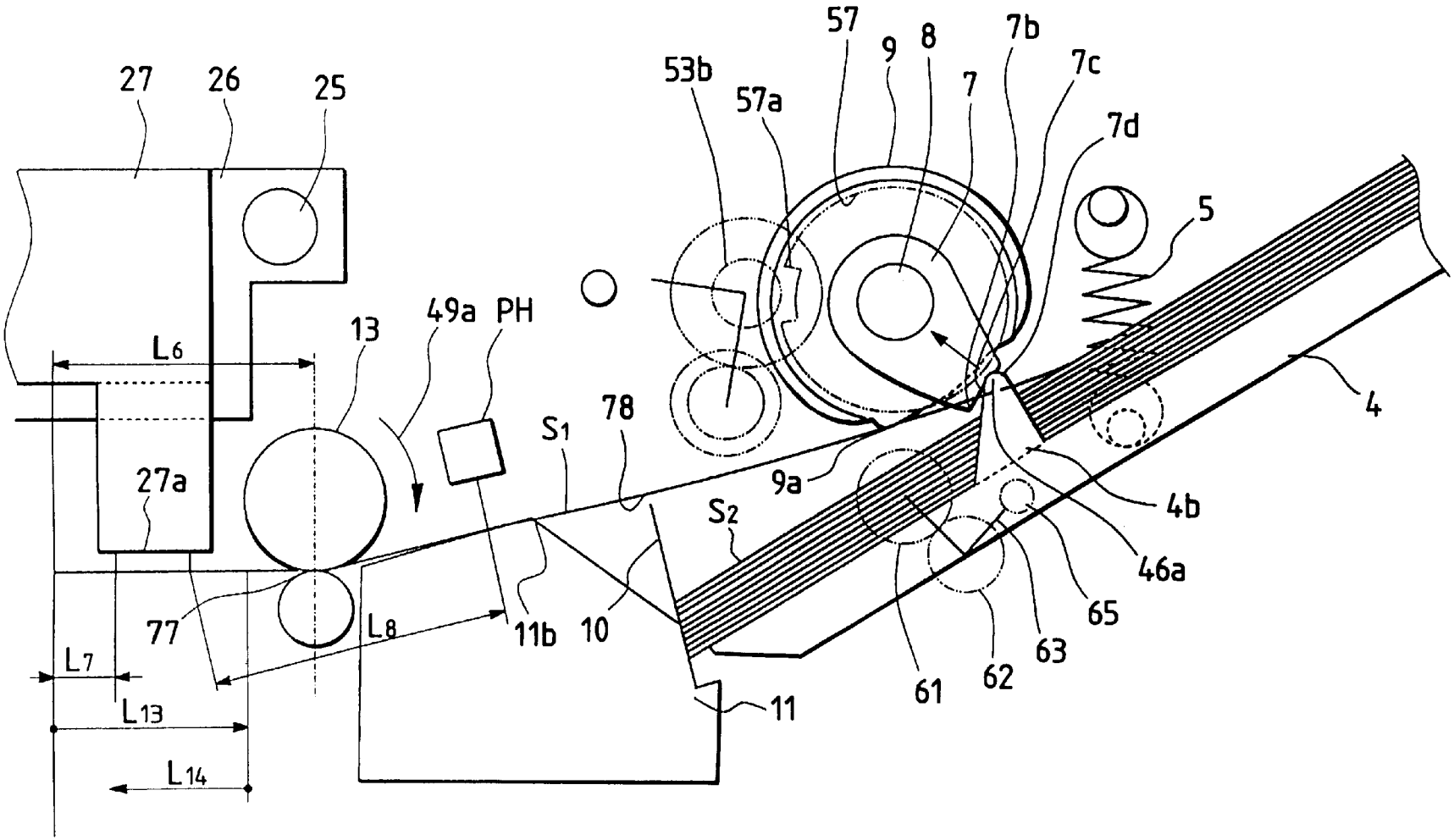
FIG. 12 is a side view of the sheet supply apparatus showing a condition when a non-toothed portion of a notched gear after the sheet supply roller and the sheet are separated from each other.

In FIGS. 11 and 12, at the same time when the maximum lift portion 7*b* of the drive cam 7 passes through an abutment portion 46*a* of the cam follower 4*b*, since the non-toothed portion 57*a* of the gear 57 reaches the small planetary gear 53*b* of the first planetary gear 53, the transmission of the driving force from the small planetary gear 53*b* is interrupted, thereby stopping the gear 57 and the sheet supply rollers 9.

Immediately after the gear 57 is stopped, the inclined surface 7*c* of the drive cam 7 is urged by the abutment portion 46*a* of the follower portion 4*b* under the action of the force $F_{11}$ of the spring 5, the inclined surface 7*c* is subjected to a force component $F_{12}$, with the result that the drive cam 7 and the gear 57 are slightly rotated in the direction 8*a*. When the abutment portion 46*a* slides on the inclined surface 7*c* to reach the stop position lift surface 7*d* of the drive cam 7, the rotation of the drive cam 7 is stopped.

Incidentally, the lift surface 7*d* of the drive cam 7 and the abutment portion 46*a* of the cam follower portion 4*b* have semi-circular shapes having substantially the same radii so that, when they are fitted to each other, the cam is stopped. In this case, the force (spring force of the spring 5) acting on the drive cam 7 from the follower portion 4*b* is directed toward the axis of the shaft 8 so that the cam can surely be stopped by the friction between the lift surface 7*d* and the abutment portion 46*a*.

In FIG. 12, the abutment portion is engaged by the stop position lift surface 7*d*, the phase of the non-toothed portion 57*a* of the gear 57 is slightly advanced from a position where the small planetary gear 53*b* of the first planetary gear 53 is not engaged with the non-toothed portion 57*a*. By advancing the phase of the notched gear 57 by the predetermined amount in this way, since the teeth of the gear 57 near the non-toothed portion 57*a* are completely retarded from the position where the teeth is engaged by the teeth of the small planetary gear 53*b*, when the small planetary gear 53*b* is idly rotated, the teeth of the small planetary gear do not interface with the teeth of the gear 57, thereby preventing the occurrence of the noise. Incidentally, the fitting relation between the drive cam 7 and the cam follower portion may be reversed. That is to say, the drive cam may had a convex stop position lift surface and the cam follower portion 4*b* may has a concave configuration.

In FIG. 12, when the motor M is rotated by the amount corresponding to the number $P_4$ of pulses, the tip end of the sheet $S_1$ is conveyed by the convey roller 13 up to the position advanced from the nip 77 by the distance $L_6$. The distance $L_6$ is set by the controller 34 so that the recording position of the leading nozzle of the ink discharge portion 27*a* of the recording head 27 is spaced apart from the tip end of the sheet $S_1$ by a predetermined distance $L_7$. The operator can input the value of the distance $L_7$ (for example, 1.5 mm or 3 mm) into the controller 34 of the printer through a computer connected to the printer.

While the tip end of the sheet $S_1$ is being conveyed to the position $L_6$ by the sheet supply rollers 9 and the convey roller 13, the abutment portion 46*a* of the cam follower portion 4*b* must be engaged by the stop position lift surface 7*d* of the drive cam 7. In FIG. 12, if the distance $L_7$ is set to a smaller value not to ensure the engagement between the lift surface 7*d* and the abutment portion 46*a*, the sheet is firstly advanced by the distance $L_6$ set to the greater value, and then the sheet is returned by the reverse rotation of the convey roller 13 by a predetermined distance $L_{13}$ ($L_6>L_{13}$), and then the sheet is advanced again by the normal rotation of the convey roller 13 (to the direction 49*a*) by the record position length $L_{14}$.

As mentioned above, in the above operation, since the length $L_6$ is set to the constant value and the record position length $L_{14}$ can be freely changed, the engagement between the lift surface 7*d* of the drive cam and the abutment portion 46*a* of the cam follower portion 4*b* is ensured. Further, since the sheet is advanced by the distance $L_{14}$ after the sheet was returned by the distance $L_{13}$, the backlash in the gear train for transmitting the rotation of the motor M to the convey roller 13 becomes zero, with the result that the conveying accuracy of the convey roller for conveying the sheet to the record position $L_{14}$ is improved.

In FIGS. 1 and 12, while the carriage 26 is being reciprocally shifted in the main scan direction above the sheet $S_1$ conveyed to the record position, the ink is discharged from the discharge portion 27*a* of the recording head 27 under the control of the controller 34, thereby recording the predetermined image on the sheet $S_1$. After one-line recording is finished, the controller 34 controls the motor M to convey the sheet by a predetermined amount corresponding to one line in the sub scan direction.

By repeating the above operations, the characters and/or image are formed on the whole recording area of the sheet $S_1$ by the recording head 27.

When the sheet $S_1$ is shifted by the convey roller 13 in the sub scan direction, although the sheet $S_1$ is conveyed with a slightly curved configuration by regulating the sheet by the flange portions 9*a* of the sheet supply rollers 9 and the top 11*b* of the guide member 11, since the sliding resistance between the guide member 11 and the sheet $S_1$ is small, the load acting on the convey roller 13 is very small. When such a load is very small, the fluctuation in load acting on the motor M becomes smaller, and, thus, the conveying ability of the convey roller 13 is improved, thereby improving the recording ability of the recording head 27 to obtain the good image.

In FIGS. 1, 2 and 12, when the rear end of the sheet $S_1$ is detected by the photo-sensor PH, the controller 34 estimates a length $L_8$ between the detecting position of the photo-sensor PH and the trailing nozzle of the ink discharge portion 27*a*. After the recording on the sheet is effected by the recording head 27 within the length $L_8$, the convey roller 13 and the discharge rollers 20 are continuously rotated by a predetermined amount to discharge the sheet $S_1$ through the discharge opening 1*b* (FIG. 2).

After the discharge rollers 20 are continuously rotated by the predetermined amount, when the controller 34 receives the command from the computer connected to the printer, the conveyance of a sheet S (which will be described hereinbelow) is effected.

Geometrical moment of inertia Ia of a wide sheet Sa (FIG. 1) is determined by the following equation (12):

$$Ia=b_1h^3/12 \tag{12}$$

where, $b_1$ is a width of the sheet Sa and h is a thickness of the sheet Sa.

On the other hand, geometrical moment of inertia Ib of a sheet Sb having the same thickness and material as those of the sheet Sa but has a width smaller than that of the sheets Sa (for example, ½ of the width of the sheet Sa) is determined by the following equation (13):

$$Ib=b_2h^3/12=b_1h^3/2\times12=Ia/2 \quad (13)$$

where, $b_2$ is a width of the sheet Sb ($=b_1/2$) and h is a thickness of the sheet Sb.

Regarding the above equations (3) and (3'), in consideration of $I_1$=Ia, $I_1$=Ib and the equation (13), a relation between slope Aa of the sheet Sa and slope Ab of the sheet Sb becomes as follows:

$$Ab=2Aa=F_8L_2^2K_1 \quad (14)$$

i.e., $Aa=(F_8/2)\ L_2^2\ K_1$

That is to say, in order to obtain a relation Aa=Ab, the force $F_7$ for flexing the sheet Sb by the abutment members 10 may be changed to $F_7\times(½)$.

On the other hand, from the above equations (5) and (5a), the following relation (15) can be derived:

$$F_7=A_2\times2\times E_2\times I_2\times n/L_3^2 \quad (15)$$

Thus, by reducing the value of "n" (number of the abutment members cooperating with the sheet) in the above equation (15) from 2 to 1, the force $F_7$ for flexing the sheet Sb can be reduced to ½.

In the illustrated embodiment, while an example that two abutment members are used was explained, when it is desired that various kinds of sheets are treated, by increasing the number of the abutment members cooperating with the sheet in proportion to the kinds of sheets, whenever the size of the sheet is changed, the number of the abutment members cooperating with such sheet is changed to establish the relations (13), (14) and (15), with the result that, since the slope $A_1$ of the sheet is not so changed greatly by the difference in size of the sheet, thereby ensuring the positive second separating action.

Figure 13:
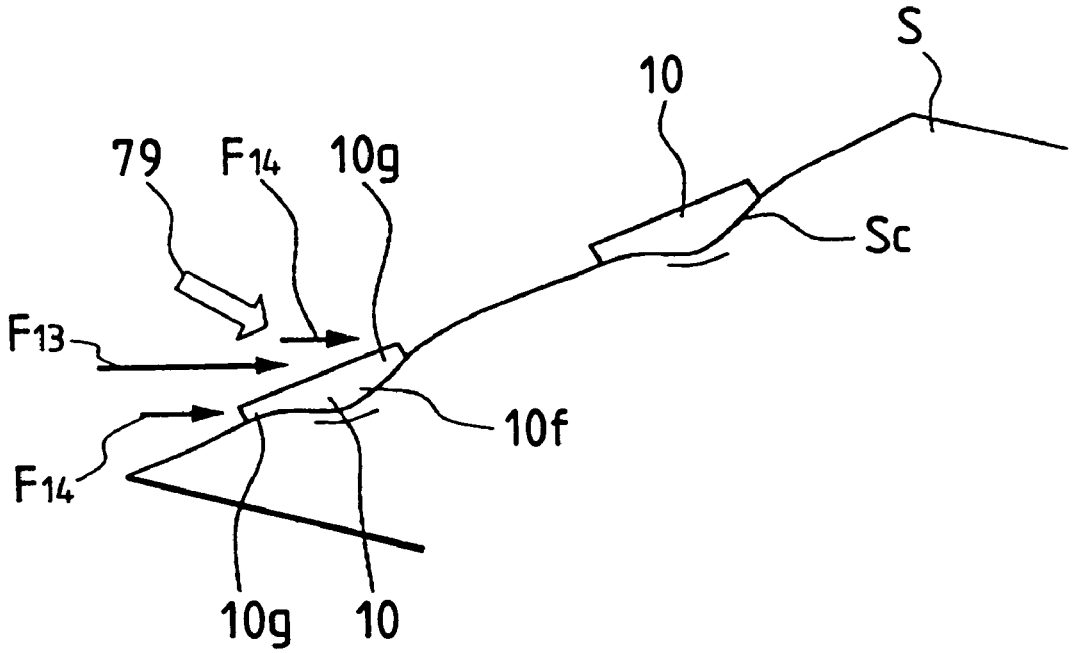
FIG. 13 is a perspective view showing a relation between forces when the sheet is urged against separation members of the sheet supply apparatus.

Next, the shape of the abutment member 10 will be explained with reference to FIGS. 13 to 16. FIG. 13 is a perspective view showing a condition that the sheet S is urged against rectangular abutment members 10.

Figure 14:
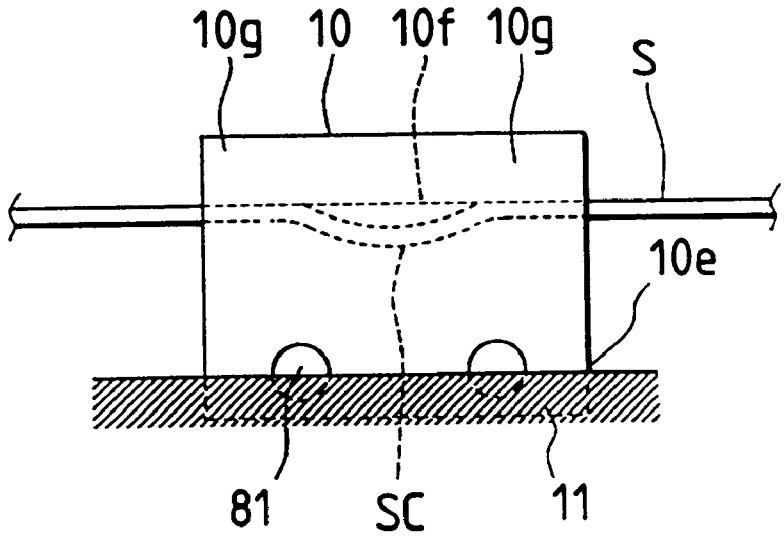
FIG. 14 is a front view showing the condition of FIG. 13 regarding one separation member.

In FIGS. 13 and 14, when the moving sheet S is urged against the abutment member 10 which is attached to the guide member for flexing movement around a base line 10*e* and the abutment member is flexed around the base line 10*e*, a portion Sc of the tip end of the sheet urged against a central portion of the abutment member 10 is deflected downwardly as shown. When the tip end portion Sc of the sheet is deflected downwardly, the great noise will be generated when the tip end of the sheet rides over the abutment member 10. Further, particularly under the high humidity environment, the deflected tip end portion Sc of the sheet is folded or bent downwardly so that the tip end portion Sc cannot ride over the abutment member, thereby causing the poor sheet separation.

The reason why the tip end portion Sc of the sheet S is deflected downwardly is that a reaction force (generated when the abutment member is flexed by the sheet S) is greater at a central portion 10*f* (reaction force $F_{13}$) than at end portions 10*g* (reaction force $F_{14}$).

Figure 15:
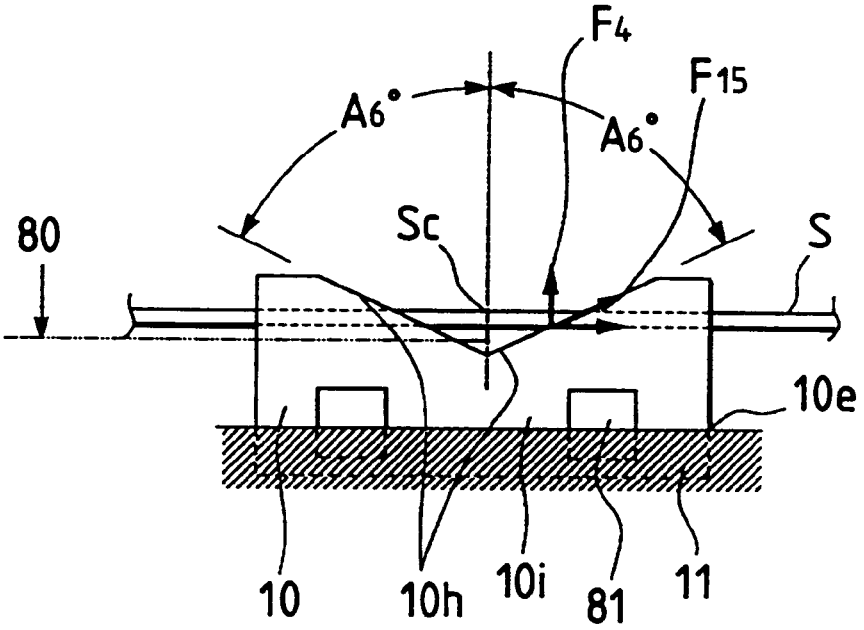
FIG. 15 is a front view showing a configuration of a separation member provided in the sheet supply apparatus.

FIG. 15 shows the shape of the abutment member for preventing the tip end portion Sc of the sheet from deflecting downwardly. In this example, a V-shaped notch is formed in the central portion of the abutment member 10 against which the tip end portion Sc is urged. In this abutment member having the V-shaped notch, when the sheet S is urged against the abutment member 10, since the tip end portion Sc of the sheet S is not subjected to the reaction force $F_{13}$ in FIG. 13, the tip end portion Sc is not deflected downwardly.

On the other hand, the force $F_4$ of FIG. 7 (sliding force of the sheet on the abutment member) and a force $F_{15}$ of component of the force $F_4$ act on each of points 10*i* where the tip end of the sheet S is contacted with the inclined edges of V of the notch.

When an angle of V of the notch is 2 $A_6°$ the force component $F_{15}$ is determined by the following equation:

$$F_{15}=F_4/\cos A_{6°} \quad (16)$$

Under the action of the force component $F_{15}$, the tip end of the sheet S is shifted upwardly in a direction of the force $F_{15}$ while sliding along the inclined lines 10*h* of the abutment member 10. Since the tip end of the sheet S is shifted upwardly in the direction of the force $F_{15}$, the tip end portion Sc of the sheet is prevented from deflecting downwardly. Further, while the tip end of the sheet S is being shifted upwardly along the inclined lines 10*h* of the V-shaped notch, the third separating action is effected, thereby still improving the sheet separating ability.

The third separating action is particularly effective to thin sheets. If the angle $A_6°$ of V of the notch is decreased, as is apparent from the above equation (16), the force component $F_{15}$ is reduced to intensify the third separating action, thereby improving the separating ability. However, the tip end portion Sc of the sheet is apt to be deflected downwardly. On the other hand, if the angle $A_6°$ is increased, as is apparent from the above equation (16), the force component $F_{15}$ is increased to weaken the third separating action, with the result that the second, third and other sheets are apt to be shifted upwardly, thereby causing the double-feed of sheets. According to the tests, it was found that the angle $A_6°$ is preferably 55°–75°. Incidentally, in place of the V-shaped notch, a U-shaped notch may be formed in the abutment member.

In FIG. 15, the cross-sectional area of the abutment member (for example, at a section line 80) is decreased as the section line goes upwardly, and, thus, the geometrical moment of inertia of the abutment member is greatly decreased as the section line goes upwardly. Since the cross-sectional area of the abutment member is decreased as the section line goes upwardly, in comparison with the elasticity $K_2$ of the solid abutment member in the above equation (5) (i.e., $A_2\cong F_7L_3^2K_2$), the elasticity $K'_2$ of the V-shaped abutment member is increased as the section line goes upwardly, and, thus, the slope $A'_2$ at the tip end of the V-shaped abutment member becomes greater than the above value $A_2$. If the slope $A'_2$ is great, the second, third and other sheets are apt to be slid, thereby worsening the third separating action.

Next, a shape of the abutment member for solving the problem caused by the V-shape of FIG. 15 will be explained with reference to FIG. 16.

When a width of the abutment member at its top is $L_9$ and a width of the abutment member along the base line 10*e* is $L_{10}$, by providing the shape of the abutment member having a relation $L_9>L_{10}$, the reduction ratio of the cross-sectional area of the abutment member (at the section line 80) can be decreased as the section line goes upwardly, with the result that the slope $A'_2$ at the tip end of the abutment member can approach the above value $A_2$. Since the width $L_9$ is decreased as the section line goes toward the base line 10*e*, when the second, third and other sheets are shifted downwardly, resistance force $F_{16}$ for resisting against the downward movement of the sheet S at points 10*j* are reduced, thereby facilitating the movement of the sheets.

In order to decrease the geometrical moment of inertia at the base line 10*e*, a plurality of holes 81 each having a width of $L_{11}$ are formed in the abutment member on the base line 10*e*, thereby decreasing the cross-sectional area of the abutment member along the base line 10*e*. Incidentally, in place of the holes 81, notches may be used or combination of holes and notches may be used. When the abutment member is easily flexed along the base line 10*e*, the abrupt increase in the slope of the tip end of the abutment member is suppressed, thereby further improving the second separating action.

Further, when the widths $L_9$, $L_{10}$ and a thickness t of the abutment member are constant, by increasing/decreasing the widths $L_{11}$ of the holes 81 or by increasing/decreasing the number of holes 81, the reaction forces of FIG. 13 can be adjusted in accordance with the flexibility of a sheet to be used. Incidentally, so long as the width is $L_{11}$, the shape of the holes may be circle of triangle, as well as rectangle. Even when the holes are formed in the solid abutment member as shown in FIG. 14, the same technical advantage can be obtained.

Figure 16:
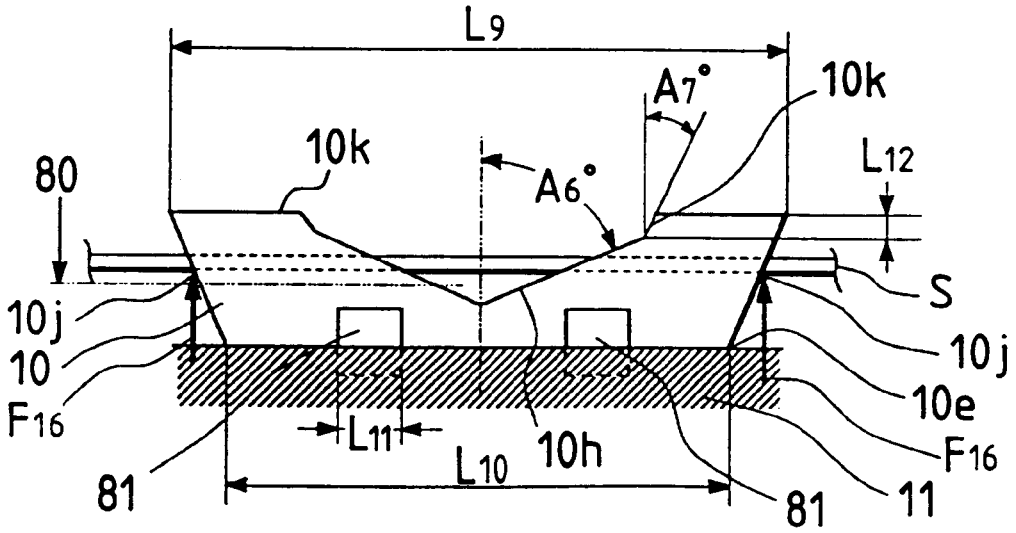
FIG. 16 is a front view showing a configuration of another separation member provided in the sheet supply apparatus.

In FIG. 16, the inclined lines 10*h* of the V-shaped notch having the inclined angle $A_6°$ are connected to additional inclined lines 10*k* each having an inclined angle $A_7°$ smaller the $A_6°$ at positions spaced apart downwardly from the top edge of the abutment member by a small distance $L_{12}$. In this case, since the sheet S is subjected to the separating action at the inclined lines 10*k* stronger than the separating action at the inclined lines 10*h*, the third separating action is further improved in comparison with the V-shaped abutment member of FIG. 15.

Incidentally, according to tests, it was found that the good result is obtained when the length $L_{11}$ is set to 1.5–3 mm, the angle $A_6°$ is set to 50–75° and the angle $A_7°$ is set to 0–40°. Further, the resin film from which the abutment member is formed is preferably made of material having high heat-deformation temperature, low humidity absorbing rate and high anti-folding ability, such as polycarbonate or polyimide. The thickness of the abutment member may be set to 0.07–0.3 mm.

(Second Embodiment)

Figure 17:
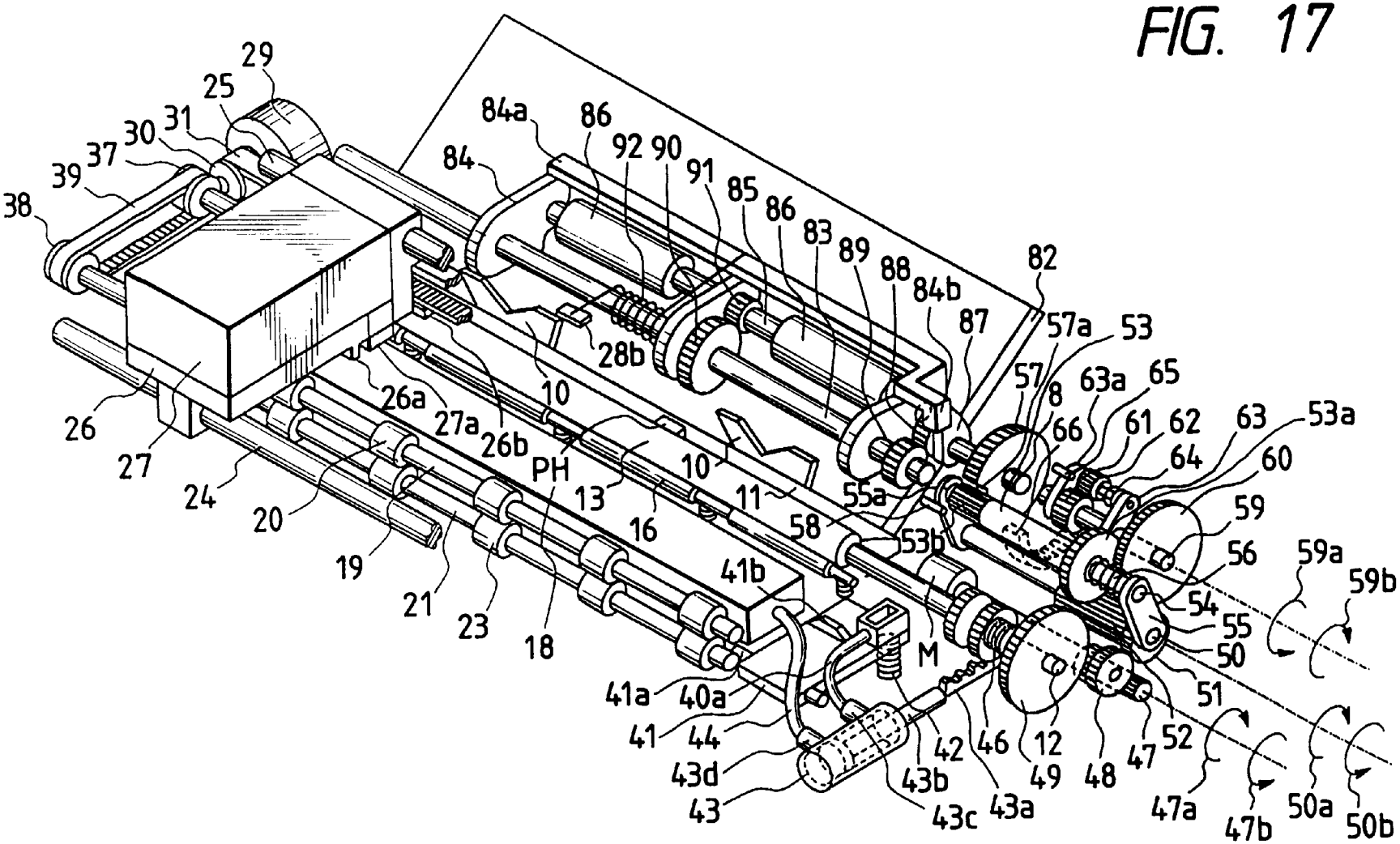
FIG. 17 is a perspective view of a recording apparatus having a sheet supply apparatus according to a second embodiment of the present invention.
Figure 18:
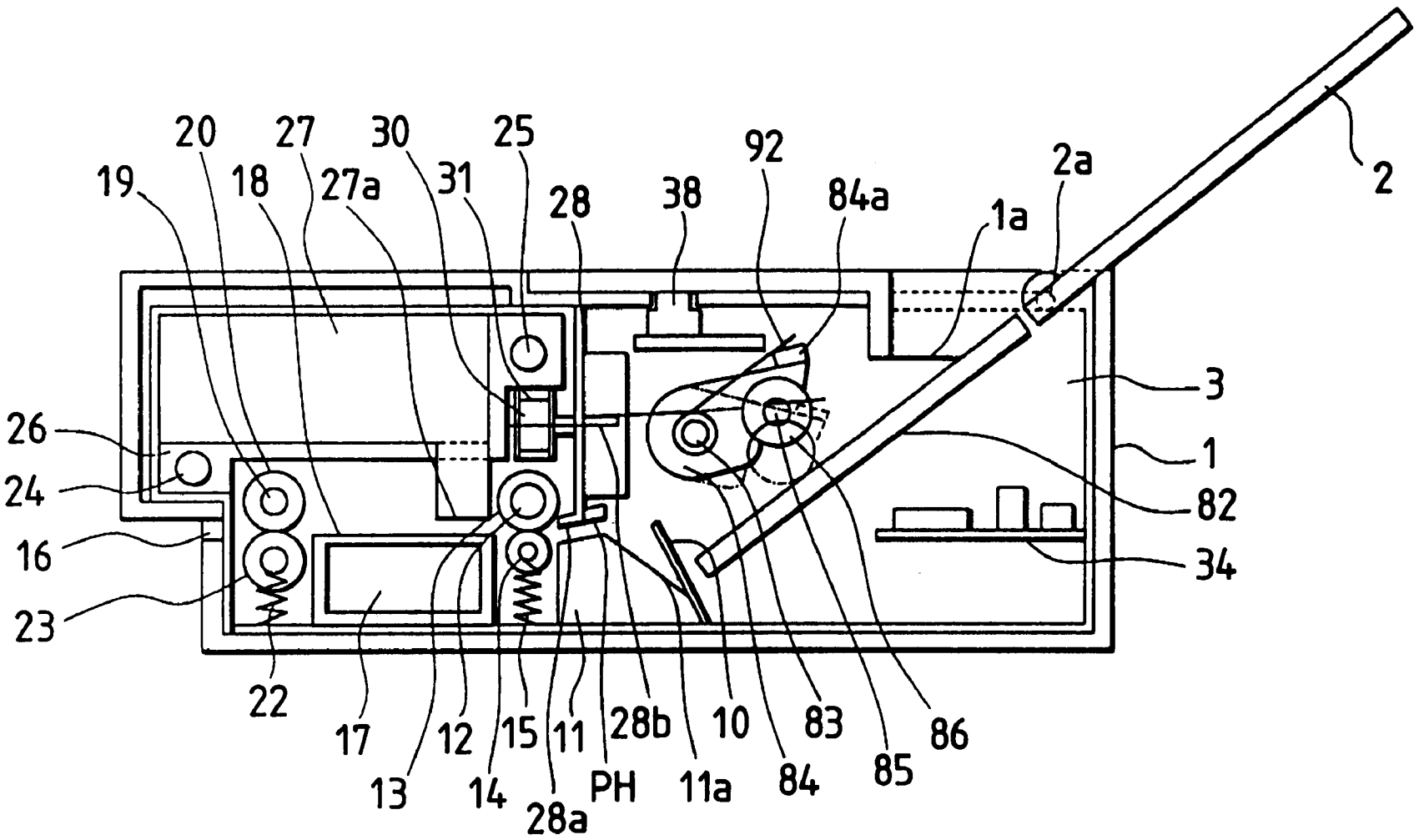
FIG. 18 is an elevational sectional view of the recording apparatus of FIG. 17.

FIGS. 17 and 18 show a second embodiment of the present invention, where FIG. 17 is a schematic perspective view of a printer to which the second embodiment is applied and FIG. 18 is a sectional view of the printer. In FIGS. 17 and 18, the same contructural and functional elements as those shown in FIGS. 1 and 2 are designated by the same reference numerals and detailed explanation thereof will be omitted.

The second embodiment differs from the first embodiment in the points that a sheet stacking plate 82 is fixedly mounted on the side plates 3 and sheet supply rollers 86 mounted on a shaft 85 rotatably supported by an arm member 84 pivotable around a shaft 83 can be rocked around the shaft 83. Now, such difference are fully explained.

In FIGS. 17 and 18, the gear 57 having the non-toothed portion 57*a*, a cam member 87 and a gear 88 are secured to the shaft 8. A gear 89 and a gear 90 are secured to the shaft 83 rotatably supported by the side plates 3, and the gear 89 is meshed with the gear 88. The arm member 84 having a plurality of arm elements and a lateral tray member 84*a* connecting the arm elements is rotatably mounted on the shaft 83.

The shaft 85 is rotatably supported by a free end portion of the arm member 84, and the sheet supply rollers 86 made of rubber and a gear 91 are secured to the shaft 85. The gear 91 is always meshed with the gear 90. Since a diameter of each of the sheet supply rollers 86 is smaller than that of the sheet supply roller 9 in the first embodiment, the sheet conveying amount obtained by one revolution of the gear 57 is smaller than that in the first embodiment. Thus, by increasing the number of teeth of the gear 90 greater than that of the gear 91, the rotational amount of the sheet supply rollers 86 is increased.

The arm member 84 is biased to rotate around the shaft 83 toward a clockwise direction by a spring member 92 having one end connected to a spring holder 28*b* and the other end connected to the lateral stay member 84*a*. Thus, when a cam follower portion 84*b* provided on the arm member is disengaged from the cam member 87, the sheet supply rollers 86 (FIG. 18) is urged against an upper surface of the sheet stacking plate 82 as shown by the two-dot and chain line.

Next, the sheet supplying operation and the recording operation according to the second embodiment will be explained with reference to FIGS. 17, 18 and 19 to 23. FIGS. 19 to 23 are sectional views showing main elements of FIG. 17 for supplying the sheet, and the same elements as those shown in FIG. 17 are designated by the same reference numerals.

Figure 19:
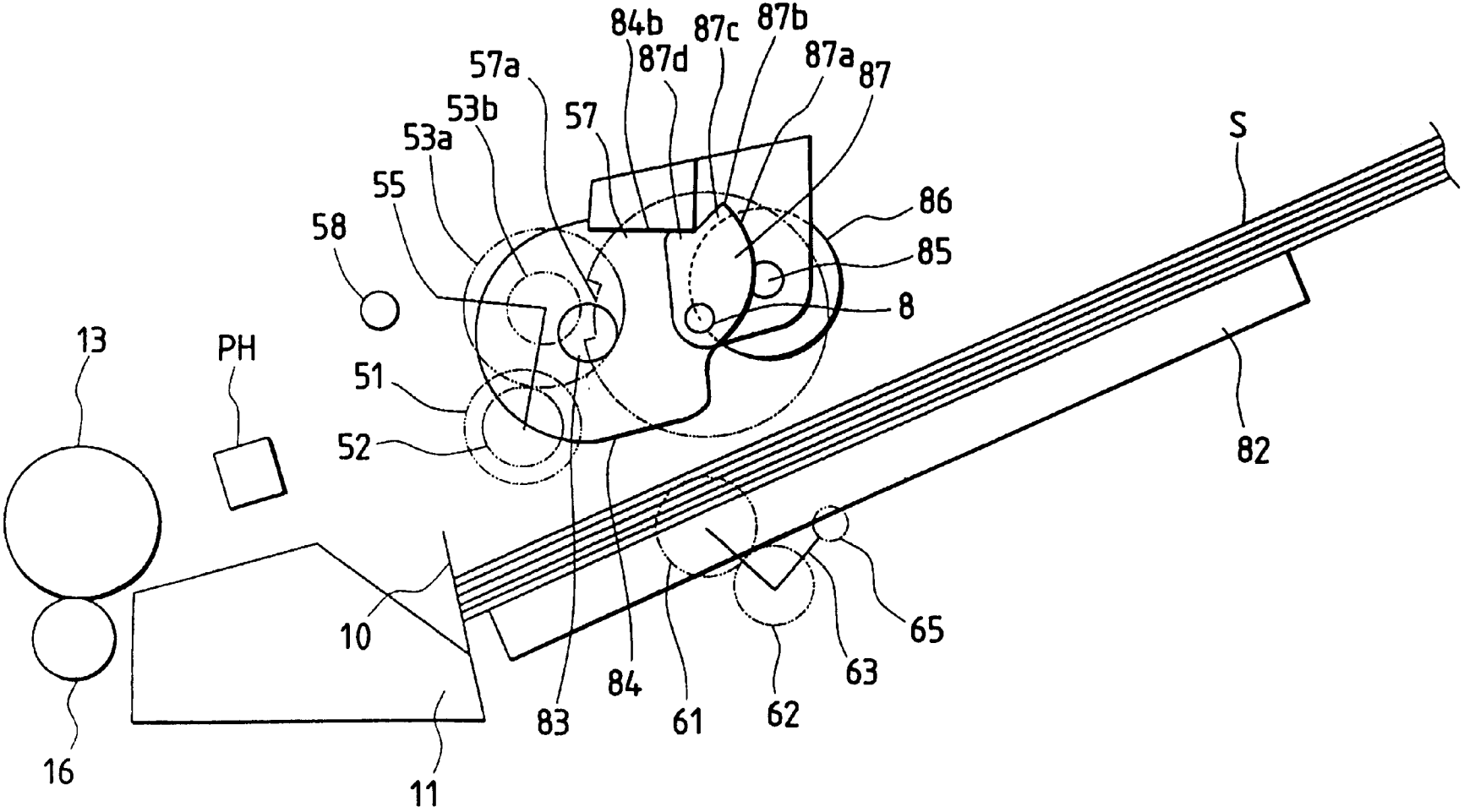
FIG. 19 is a side view of the sheet supply apparatus of FIG. 17 showing a condition that sheets are not yet separated.

In FIGS. 18 and 19, when the power source of the printer is turned ON, in response to initialization command from the controller 34, the motor M of FIG. 17 is rotated in the direction 47*a* (i.e., the convey roller 13 is rotated to convey the sheet in the sub scan direction toward the discharge opening 16) by a predetermined amount. As a result, the small planetary gear 53*b* of the first planetary gear 53 is idly rotated in the non-toothed portion 57*a* of the gear 57, the second planetary gear 62 is idly rotated at the position where the arm portion 63*a* of the carrier 63 abuts against the stopper pin 65, and a stop position lift surface 87*d* of the cam member 87 abuts against the follower portion 84*b* of the arm member 84 to rotate the arm member 84 in an anti-clockwise direction, thereby separating the sheet supply rollers 86 from the sheet stacking plate 82 (condition shown in FIG. 19). In this condition, a plurality of sheets S are stacked on the sheet stacking plate 82 by inserting the sheets between the sheet stacking plate 82 and the sheet supply rollers 86.

Figure 20:
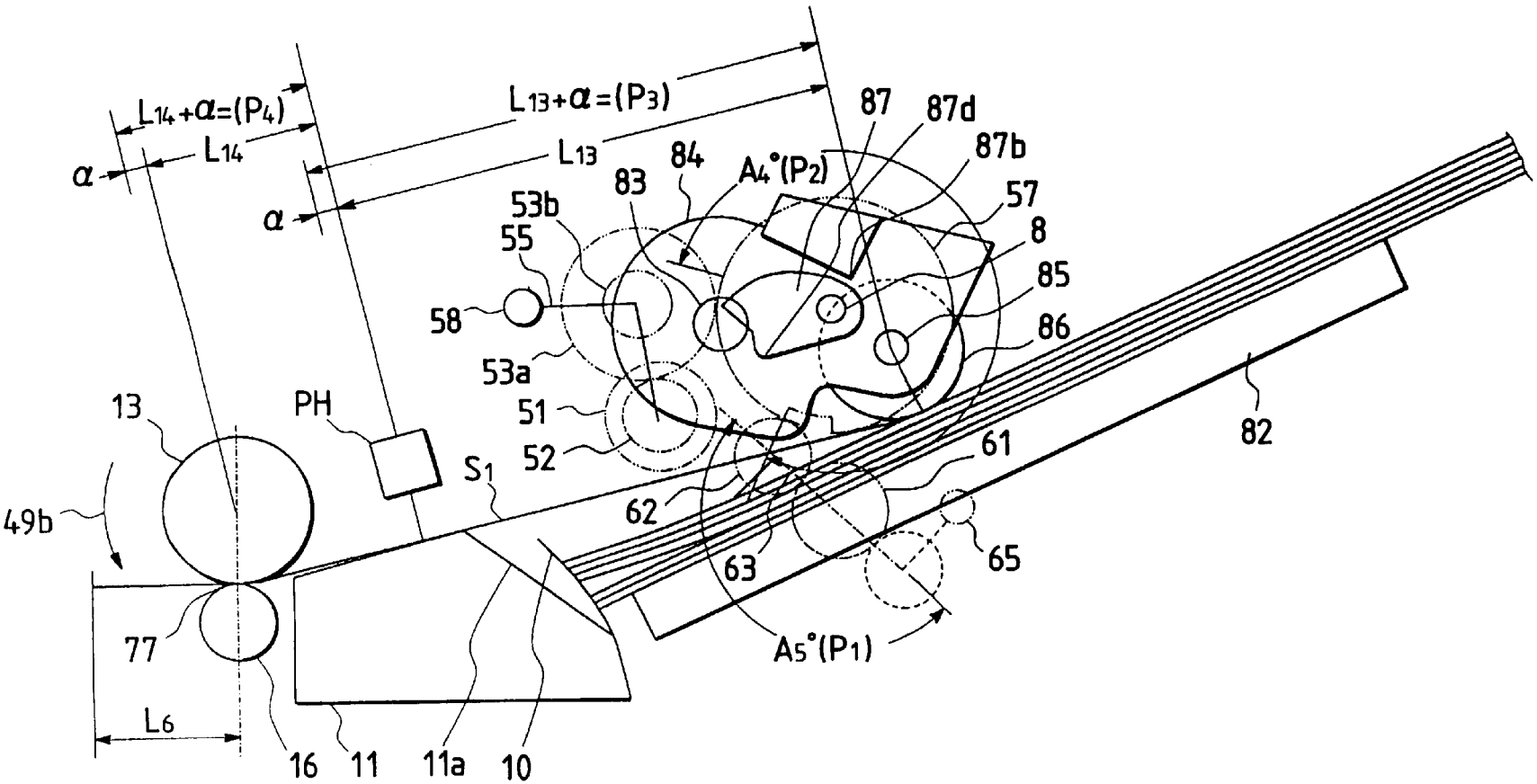
FIG. 20 is a side view of the sheet supply apparatus of FIG. 17 showing various feeding amounts for the sheets.
Figure 21:
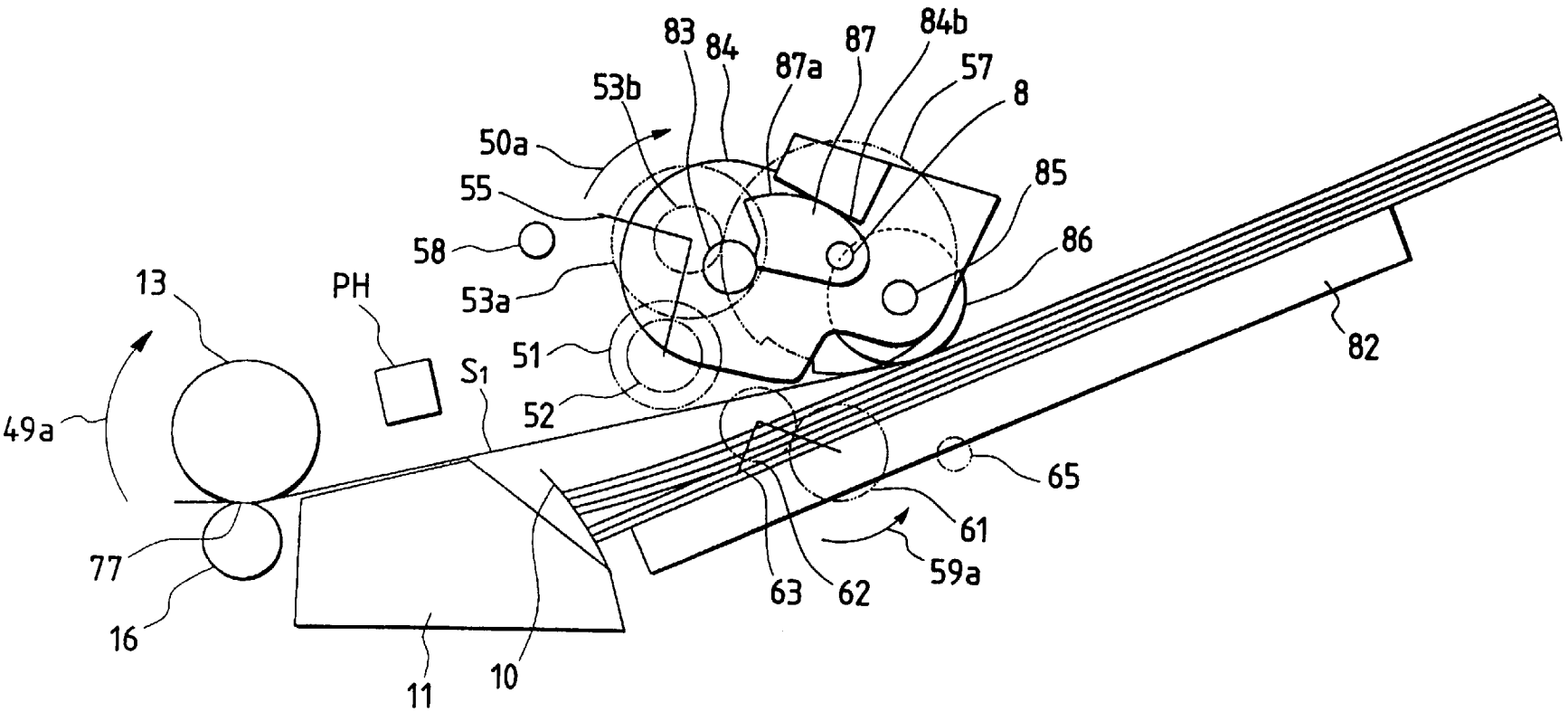
FIG. 21 is a side view of a drive transmission mechanism of the sheet supply apparatus of FIG. 17 showing a condition when the reverse rotation condition is switched to the normal rotation condition.

In FIGS. 4 and 20, when the motor M is rotated in the direction 47*b* by a predetermined amount in response to the sheet supply command from the controller 34, the second planetary gear 62 is revolved from a position where the second carrier 63 is contacted with the pin 65 to a position where the second planetary gear is engaged by the gear 57. When the second planetary gear 62 is engaged by the gear 57, since the rotation of the motor M in the direction 47*b* is transmitted to the gear 57, the sheet supply rollers 86 are rotated in the sheet supplying direction via the shaft 8, gears 88, 89 shaft 83, gears 90, 91 and shaft 85.

On the other hand, the cam member 87 is rotated by the rotation of the shaft 8 to disengage the stop position lift surface 76*d* from the follower portion 84*b*, with the result that the sheet supply rollers 86 is urged against the uppermost sheet $S_1$ on the sheet stack rested on the sheet stacking plate, thereby supplying the sheet $S_1$. The supplied sheet $S_1$ abuts against the abutment members 10, thereby flexing the abutment members to change their inclination angle. When the abutment members are flexed up to the second separating angle, the sheet $S_1$ is separated from the other sheets by the abutment members 10, and the separated sheet rides over the tip ends of the abutment members 10 and then is directed upwardly along the inclined surface 11*a* of the guide member 11.

In FIG. 20, when the tip end of the separated sheet passes by the photo-sensor PH, the latter emits a signal. In response to this signal, under the control of the controller 34 of FIG. 18, the motor M is rotated in the reverse direction by the number $P_4$ of pulses corresponding to a distance of $(L_{13}+\alpha)$ ($\alpha$=margin=2–5 mm) and then is stopped temporarily. The tip end of the sheet $S_1$ is urged against the nip 77 between the reversely rotating convey roller 13 (in the direction 49*b*) and the first pinch rollers 16 by the sheet supply rollers 86 driven by the number $P_4$ of pulses of the motor, thereby stopping the tip end of the sheet $S_1$. In the condition that the tip end of the sheet $S_1$ is stopped, if the sheet supply rollers 86 are still being rotated, the sheet supply rollers 86 are rotated while slipping on the sheet $S_1$.

If the sheet $S_1$ is skew-fed, although one of the corners of the tip end of the sheet is firstly contacted with the nip 77 and is stopped there, since the other corner of the tip end of the sheet is still moved, the sheet is turned around the contacted one corner (of the tip end thereof). As a result, the whole length of the tip end of the sheet is aligned with the nip 77, thereby correcting the skew-feed of the sheet.

After the motor is rotated by the number $P_4$ of pulses, the motor M is rotated in the normal direction shown by the arrow 47*a* by the number $P_5$ of pulses corresponding to a convey distance $L_6$ effected by the convey roller 13. The sheet supply rollers 86 are further rotated by the number $P_5$ of pulses of the motor M, thereby penetrating the tip end of the sheet $S_1$ into the nip 77. The penetrated tip end of the sheet $S_1$ is conveyed by the distance $L_6$ by rotating the convey roller 13 in the direction opposite to the direction 49*b*.

In FIGS. 20 and 24, in various steps, the numbers of pulses applied to the motor M are as follows:

$P_1$=number of pulses required for revolve the second planetary gear 61 by an angle $A_5$°;

$P_2$=number of pulses corresponding to an angle $A_4$° through which the non-toothed portion of the gear 57 is rotated from the position where it is opposed to the first planetary gear 53 to the position where it is opposed to the second planetary gear;

$P_3$=number of pulses corresponding to the rotation of the sheet supply roller 86 by a distance ($L_{13}+\alpha$) ($\alpha$=2–5 mm);

$P_4$=number of pulses corresponding to the rotation of the sheet supply roller 86 by a distance ($L_{14}+\alpha$) ($\alpha$=2–5 mm);

$P_5$=number of pulses corresponding to the rotation of the convey roller 13 by a distance $L_6$; and $P_6$=number of pulses corresponding to a convey distance through which the sheet is conveyed by the convey roller 13 by an amount corresponding to twice of longitudinal length of the maximum available sheet.

Since the operating sequence for the motor M regarding FIG. 24 is the same as that in the first embodiment explained in connection with FIGS. 9 and 24, explanation thereof will be omitted.

The controller 34 rotates the motor M by the number $P_4$ of pulses to convey the sheet by the distance $L_{13}$ and then stops the motor temporarily. Then, when the motor M of FIG. 17 is rotated in the direction 47*a*, in FIG. 21, since the convey roller 13 is rotated in the direction 49*a* and the first carrier 55 is rotated in the direction 50*a*, the small planetary gear 53*b* of the first planetary gear 53 is engaged by the gear 57, with the result that the rotational force of the motor M is transmitted to the sheet supply rollers 86, thereby rotating the latter. When the sheet supply rollers 86 are rotated, since the tip end of the sheet $S_1$ is urged against the nip 77 between the rotating convey roller 13 (to the direction 49*a*) and the first pinch rollers 16, the tip end of the sheet $S_1$ can pass through the nip 77.

Since the cam member 87 is also rotated by the rotation of the gear 57, a drive lift surface 87*a* of the cam member 87 abuts against the follower portion 84*b* of the arm member 84. When the cam member 87 is further rotated, the arm member 84 is rotated around the shaft 83 in the anti-clockwise direction, thereby separating the sheet supply rollers 86 from the sheet $S_1$. When the motor M is rotated in the direction 47*a*, since the second carrier 63 is rotated in the direction 59*a*, the second planetary gear 62 is shifted away from the position where the second planetary gear is engaged by the gear 47, with the result that the second planetary gear is revolved in the same direction 59*a*.

Figure 22:
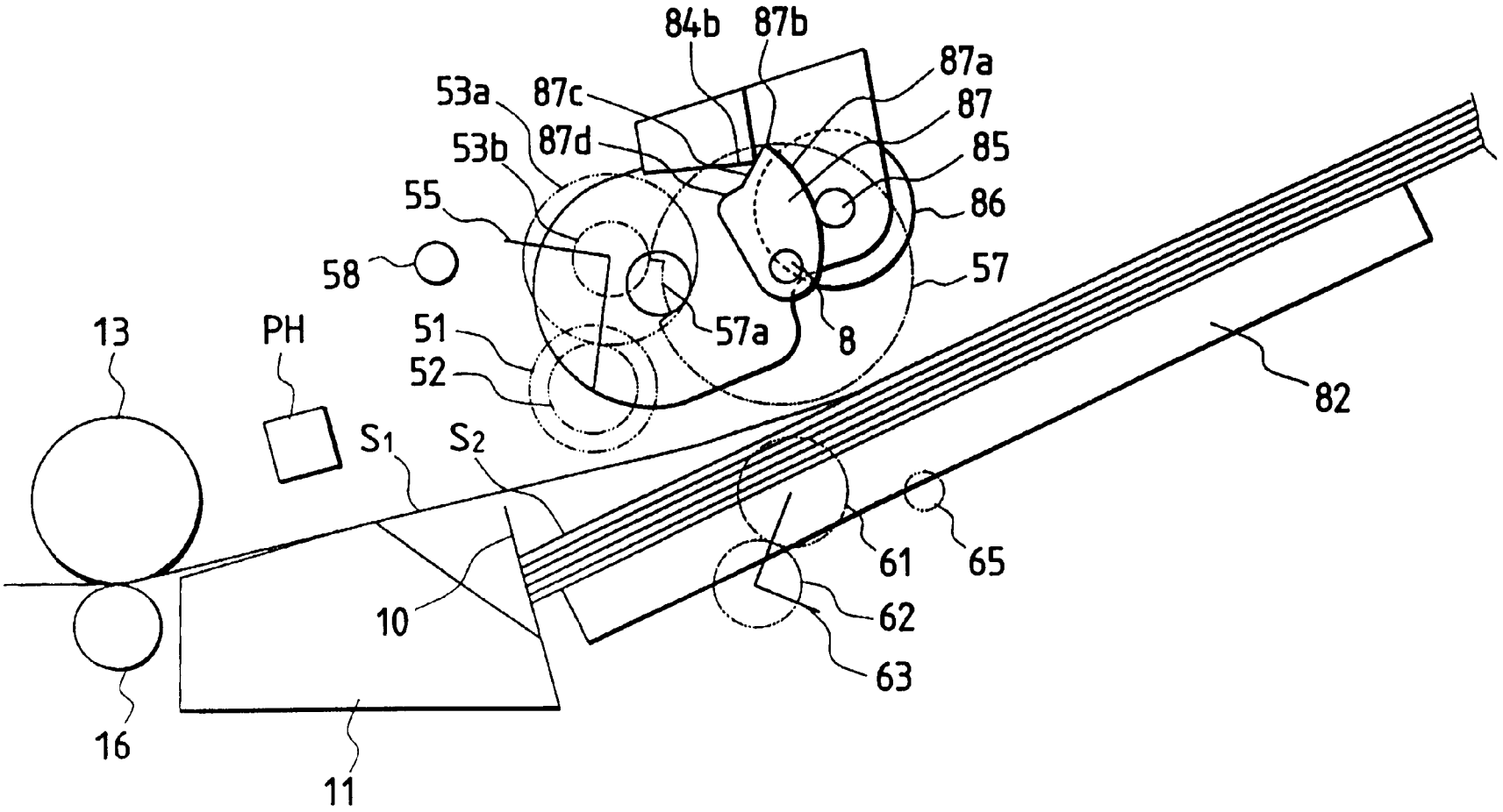
FIG. 22 is a side view of the sheet supply apparatus showing a condition when the separation between a sheet supply roller and the sheet is started.

In FIG. 22, immediately after a maximum lift surface 87*b* of the cam member 87 passes through an abutment portion of the follower portion 84*b*, since the non-toothed portion 57*a* of the gear 57 reaches the position where it is opposed to the small planetary gear 53*b* of the first planetary gear 53, the transmission of the rotational force from the small planetary gear 53*b* to the gear 57 is interrupted, thereby stopping the gear 57 and the sheet supply rollers 86.

Figure 23:
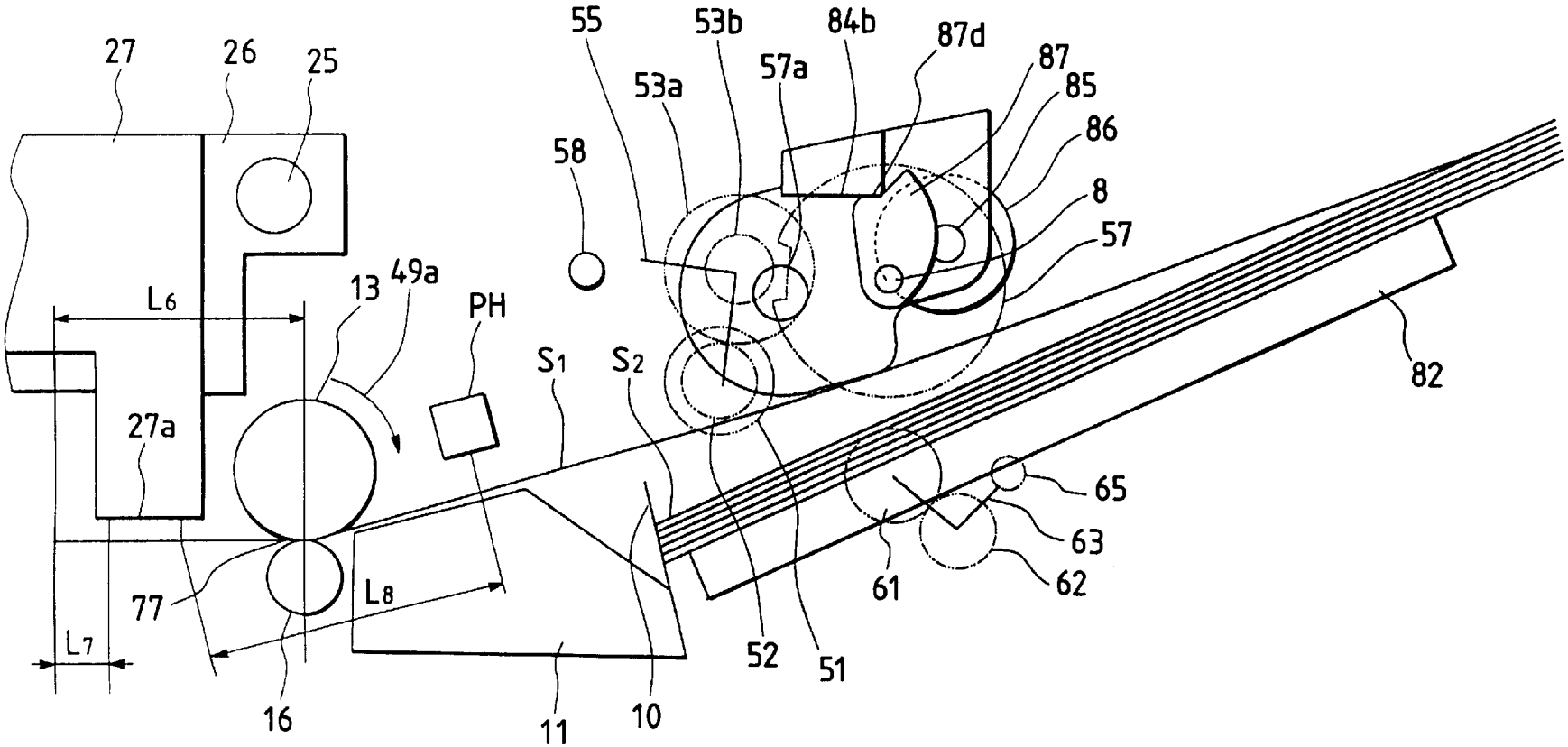
FIG. 23 is a side view of the sheet supply apparatus, for explaining registration of the sheet.

Immediately after the gear 57 is stopped, an inclined surface 87*c* of the cam member 87 is urged by the follower portion 84*b* under the action of the spring 92 of FIG. 17, the cam member 87 is rotated in the clockwise direction, thereby rotating the gear 57 slightly. In FIG. 23, when the follower portion 84*b* slides on the inclined surface 87*c* to reach the stop position lift surface 87*d* of the cam member 87, the rotation of the cam member 87 is stopped, and, thus, the rotation of the gear 57 is stopped. When the gear 57 is rotated slightly, since the phase of the stop position of the non-toothed portion 57*a* is slightly advanced and the non-toothed portion 57*a* is completely retarded from the position where it is engaged by the small planetary gear 53*b* of the first planetary gear 53, while the small planetary gear 53*b* is being rotated idly, the teeth of the gears 57, 53*b* do not interface with each other, thereby preventing the occurrence of noise and/or vibration.

In FIGS. 22 and 23, when the sheet supply rollers 86 urging the sheet $S_1$ are rotated in the clockwise direction, the second, third and other sheets are released from the urging force, with the result that these sheets are returned to the set position by the restoring force of the abutment members 10. In this way, the load acting on the abutment members is removed. Since the supplying of the second, third and other sheets is always started from the set position and, thus, the flexing movement of the abutment members is always started from the set position, the same separating operation is always ensured.

In FIG. 23, when the motor M is rotated by the number $P_4$ of pulses corresponding to the length $L_6$, the convey roller 13 is rotated in the direction 49*a* to convey the tip end of the sheet $S_1$ to the position spaced apart from the nip 77 by the distance $L_6$. The distance $L_6$ is set so that the recording position of the leading nozzle of the ink discharge portion 27*a* of the recording head 27 is spaced apart from the tip end of the sheet $S_1$ by a predetermined distance $L_7$.

In FIGS. 17 and 23, while the carriage 26 is being reciprocally shifted in the main scan direction above the sheet $S_1$ conveyed to the record position, the ink is discharged from the discharge portion 27*a* of the recording head 27 under the control of the controller 34, thereby recording the predetermined characters and/or image on the sheet $S_1$. After one-line recording is finished, the controller 34 rotates the motor M in the direction 47 to convey the sheet by a predetermined amount corresponding to one line. By repeating the above operations, the characters and/or image are formed on the whole recording area of the sheet $S_1$ by the recording head 27.

In FIGS. 17, 18 and 23, when the rear end of the sheet $S_1$ is detected by the photo-sensor PH, the controller 34 estimates a length $L_8$ between the detecting position of the photo-sensor PH and the trailing nozzle of the ink discharge portion 27*a*. After the recording on the sheet is effected by the recording head 27 within the length $L_8$, the convey roller 13 and the discharge rollers 20 are continuously rotated by a predetermined amount to discharge the sheet $S_1$ through the discharge opening 1*b* (FIG. 18). After the discharge rollers 20 are continuously rotated by the predetermined amount, when the controller 34 receives the command from the computer connected to the printer, the conveyance of a next sheet S is effected.

(Third Embodiment)

Next, a third embodiment of the present invention will be explained with reference to FIGS. 25 to 27. Since the third embodiment differs from the first embodiment in the point that each abutment member is flexed around a plurality of lines, only such a difference will be fully explained. Further, the same elements as those in the first embodiment are designated by the same reference numerals and explanation thereof will be omitted.

Figure 25:
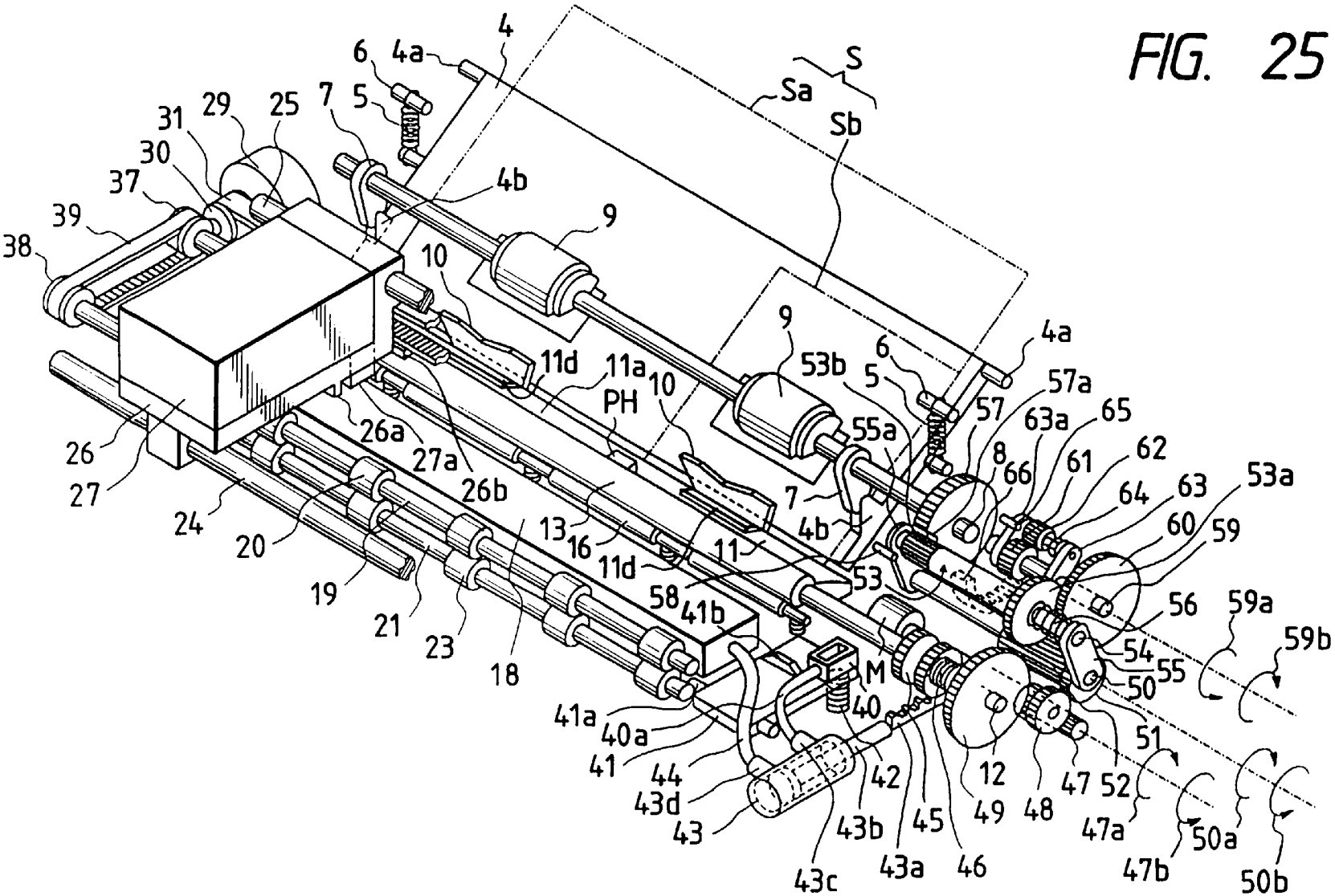
FIG. 25 is a perspective view of a recording apparatus having a sheet supply apparatus according to a third embodiment of the present invention.
Figure 26:
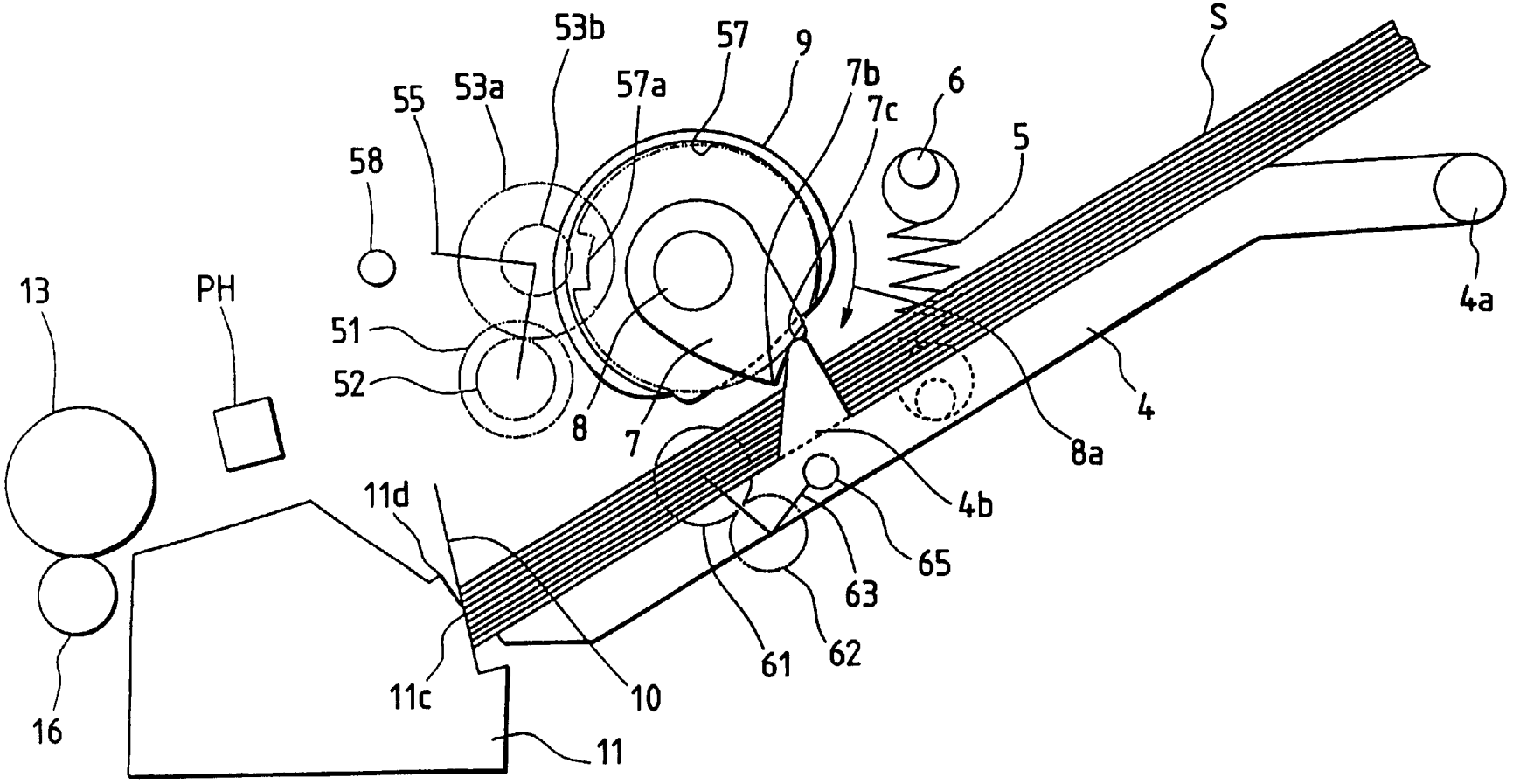
FIG. 26 is an elevational sectional view of the recording apparatus of FIG. 24.

In FIGS. 25 and 26, fulcrum portions 11*c*, 11*d* defined by stepped portions are formed on the surface 11*a* of the guide member 11, and the abutment member 10 can be flexed around the fulcrum portions 11*c*, 11*d*.

First of all, in case where each of the sheets stacked on the sheet stacking plate 4 has low surface frictional coefficient and low elasticity (low resiliency), when the sheets supplied from the sheet supply rollers 9 are urged against the abutment member 10, since the sheet has low resiliency, the abutment member is flexed only around the fulcrum portion 11*c*. In this case, since the separating operation is the same as that in the first embodiment, explanation thereof will be omitted.

Now, the case where a sheet has high surface frictional coefficient and high elasticity (high resiliency) will be explained with reference to FIG. 27.

Figure 27:
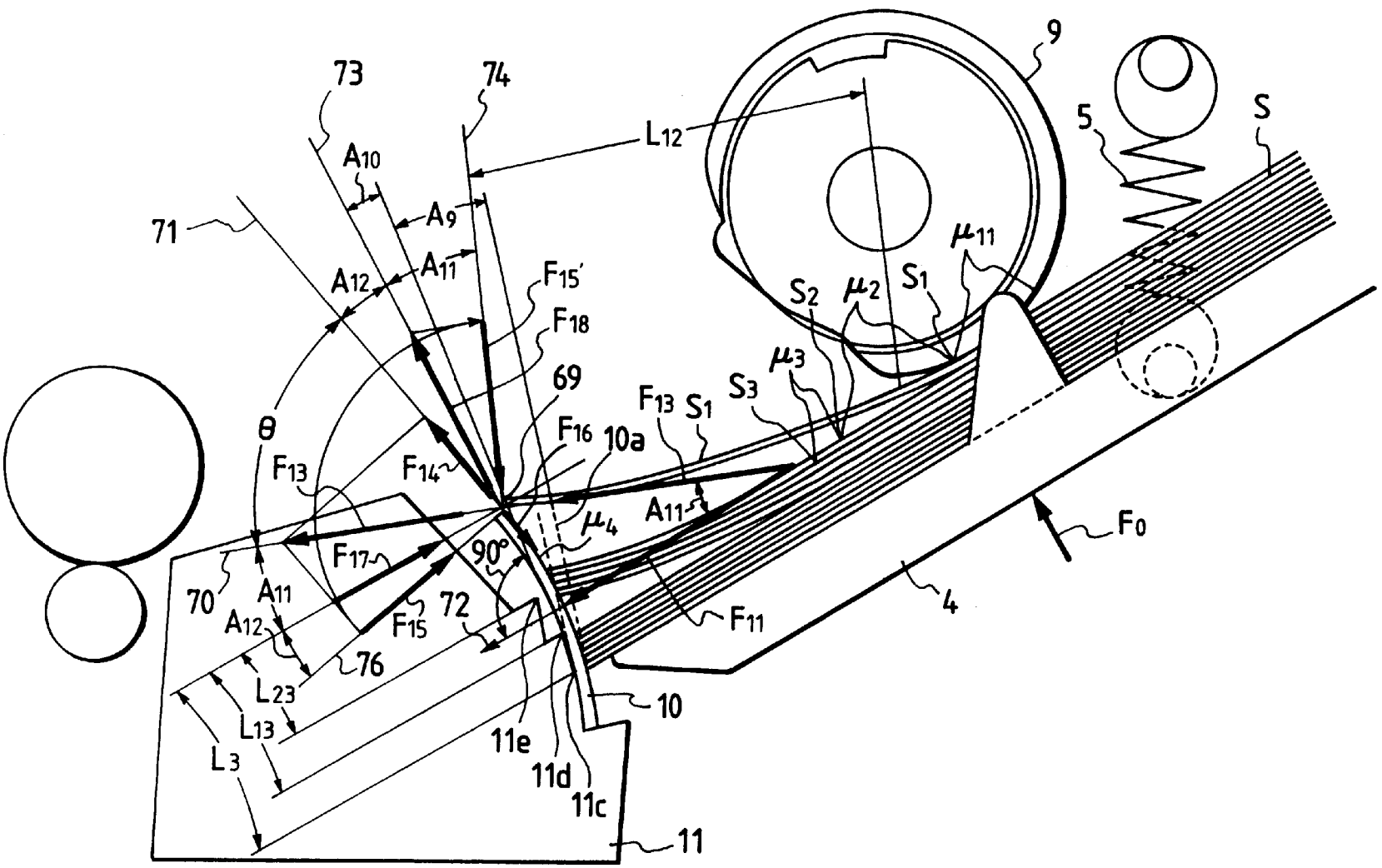
FIG. 27 is a side view showing a relation between forces in the sheet supply apparatus when the sheets are being separated.
Figure 28:
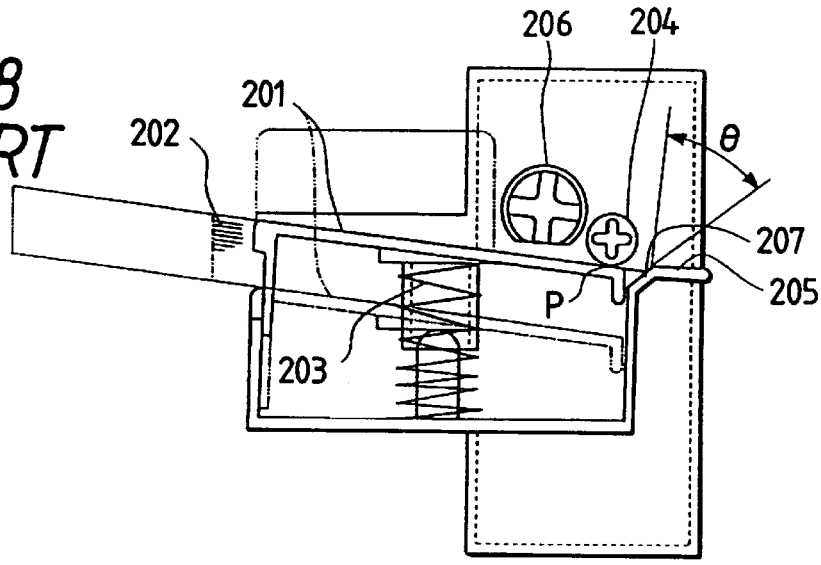
FIG. 28 PRIOR ART
FIGS. 28 to 30 are views showing an example of a conventional sheet supply apparatus.
Figure 29:
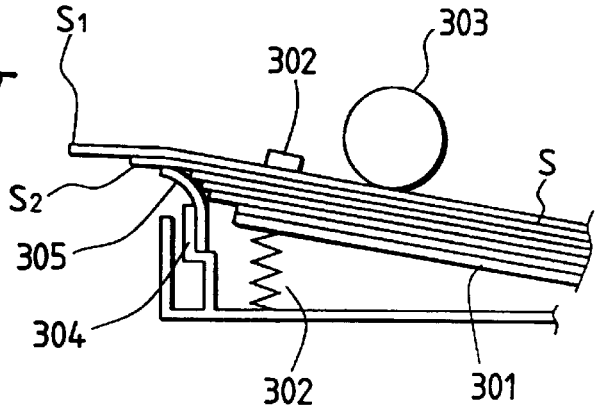
FIG. 29 PRIOR ART
Figure 30:
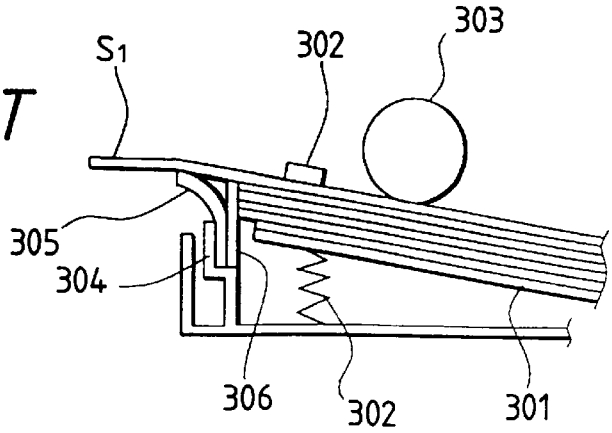
FIG. 30 PRIOR ART

In FIG. 27, when a coefficient of friction between the sheet supply roller 9 and the uppermost sheet $S_1$ is $\mu_{11}$, a coefficient of friction between the uppermost sheet $S_1$ and a second sheet $S_2$ is $\mu_2$, a coefficient of friction between the second sheet $S_2$ and a third sheet $S_3$ is $\mu_3$ and so on, a relation between the coefficient $\mu_{11}$ of friction and the coefficient $\mu_2$ of friction is $\mu_{11} >> \mu_2$. Accordingly, when the sheets S stacked on the sheet stacking plate 4 are urged against the sheet supply rollers 9 with an urging force of $F_0$ by the springs 5, the uppermost sheet $S_1$ is urged against the abutment members 10 with a shifting force of $F_{11}$ ($=F_0(\mu_{11}-\mu_2)$). On the other hand, a shifting force $F_2$ for the second sheet, third sheet and so on is $F_0(\mu_2-\mu_3)$. In this case, since $\mu_2 \cong \mu_3$, the shifting force $F_2$ is smaller than the shifting force $F_{11}$.

In FIG. 27, the abutment member 10 is flexed from the position 10*a* by an inclination angle of $(A_9+A_{10}+A_{12})$ by a force $F_{13}$ ($=F_{11} \cos A_{11}$) of the uppermost sheet $S_1$. At this point, the tip end of the sheet $S_1$ and the tip end of the abutment member 10 are elastically balanced with each other at a point 69 and the sheet $S_1$ is stopped.

Incidentally, $A_9$ is an inclination angle of the abutment member when the latter abuts against the fulcrum portion 11*d*, and $A_{10}$ is an inclination angle changed after the abutment. In the elastically balanced condition as mentioned above, the lower portion of the abutment member 10 is urged against the fulcrum portion 11*d* of the guide member 11, and, therefore, the deflection length $L_{13}$ of the abutment member 10 becomes shorter than the deflection length L3 when the abutment member is flexed around the first fulcrum portion 11*c*, with the result that the elastic force of the abutment member 10 is discontinuously increased whenever the fulcrum portion around which the abutment member is flexed is changed.

In FIG. 27, if there is no fulcrum portion 11*d* and the abutment member 10 is flexed only around the fulcrum portion 11*c*, the elastic force $F'_{17}$ of the abutment member 10 is defined by the following equation (17):

$$F'_{17} \simeq (A_9 + A_{10}) / L_3^2 K_2 = A_9 / L_3^2 K_2 + A_{10} / L_3^2 K_2 \quad (17)$$

where, $K_2$=elasticity of abutment member 10;

$A_9$=slope of abutment member up to fulcrum 11*d* [rad];

$A_{10}$=slope of abutment member from fulcrum 11*d* [rad];

$L_3$=deflection length of abutment member from fulcrum 11*c*.

Thus, the tip end portion of the sheet $S_1$ is flexed by this elastic force $F'_{17}$.

On the other hand, as shown in FIG. 27, when there is the fulcrum portion 11*d* and the abutment member 10 is flexed around the fulcrum portion 11*d*, the elastic force $F_{17}$ of the abutment member 10 is defined by the following equation (18):

$$F_{17} \cong A_9/L_3^2K_2 + A_{10}/L_{13}^2K_2 \quad (18)$$

where, $K_2$=elasticity of abutment member 10;

$A_9$=slope of abutment member up to fulcrum 11*d* [rad];

$A_{10}$=slope of abutment member from fulcrum 11*d* [rad];

$L_3$=deflection length of abutment member from fulcrum 11*c;*

$L_{13}$=deflection length of abutment member from fulcrum 11*d*.

Thus, the tip end portion of the sheet $S_1$ is flexed by this elastic force $F_{17}$.

From the above equations (17) and (18), the difference between the elastic force $F_{17}$ and the elastic force $F'_{17}$ is determined by the following equation:

$$F_{17} - F'_{17} = A_{10} / L_{13}^2 K_2 - A_{10} / L_3^2 K_2 = (A_{10} / K_2) \times \{[L_3^2 - L_{13}^2) \div (L_{13}^2 \times L_3^2)\} \quad (19)$$

Further, there is the following relation (20) between $L_3$ and $L_{13}$:

$$L_3 > L_{13} \quad (20)$$

From the above relations (19) and (20), the following relation can be derived:

$$L_3^2 - L_{13}^2 = (L_3 - L_{13})(L_3 + L_{13}) > 0 \quad (21)$$

i.e., $F_{17} - F'_{17} > 0 \therefore F_{17} > F'_{17}$

Therefore, by providing the fulcrum portion 11*d*, as shown in the above relation (21), it is possible to increase the elastic force of the abutment member 10 so that the sheets S having high elasticity can be separated one by one.

As shown in FIG. 27, by adding an additional fulcrum portion 11*e*, since the deflection length $L_{23}$ of the abutment member is further shortened to further increase the elastic force of the abutment member, with the result that sheet having higher elasticity can easily be separated one by one.

By setting the position of the most downstream fulcrum portion to a higher position, such fulcrum portion may act as a stopper for limiting the slope of the abutment member 10 to a constant value by abutting the tip end portion of the abutment member against such fulcrum portion.

In the illustrated embodiment, widths of the fulcrum portions 11*c*, 11*d* were set to be equal to the width of the abutment member, the widths of the fulcrum portions may be longer or shorter than that of the abutment member. Further, the fulcrum members may be provided intermittently. In addition, the fulcrum portions may be defined by plate-shaped ribs or ridges, as well as the stepped portions.

What is claimed is:

1. A sheet supply apparatus comprising:

sheet supporting means for supporting a plurality of sheets;

sheet supply means for feeding out the sheets supported by said sheet supporting means; and separation means for separating sheets fed out from said sheet supporting means, said separation means comprising a flexible abutment member having an abutment surface with a tip end, and said sheet supply means urging the fed sheet against the abutment surface thereby changing an inclination angle of the abutment surface relative to said sheet supporting means and separating the sheet from other sheets by riding over the abutment surface, wherein the abutment surface of said separation means is inclined toward said sheet supporting means by a predetermined angle with respect to a plane perpendicular to a direction in which the sheets supported by said sheet supporting means are fed out so that the tip end of the abutment surface comes closer to said sheet supporting means.

2. A sheet supply apparatus according to claim 1, wherein said predetermined angle is set to 5°–35°.

3. A sheet supply apparatus according to claim 1, wherein said separation means has a thin plate-shaped member which can be elastically deformed when the sheet urges and rides over said plate-shaped member.

4. A sheet supply apparatus according to claim 3, wherein a notch having a configuration gradually opened from an inside to a tip end of said plate-shaped member over which the sheet rides is formed in said plate-shaped member.

5. A sheet supply apparatus according to claim 4, wherein said notch has a V-shaped or a U-shaped configuration.

6. A sheet supply apparatus according to claim 3, wherein a width of said plate-shaped member is gradually reduced from a tip end thereof to a base end thereof at which said separation means is secured.

7. A sheet supply apparatus according to claim 3, wherein at least one hole is formed in said plate-shaped member.

8. A sheet supply apparatus according to claim 3, wherein said plate-shaped member is made of a synthetic resin film.

9. A sheet supply apparatus comprising:

sheet supporting means for supporting a plurality of sheets;

sheet supply means for feeding out the sheets supported by said sheet supporting means; and separation means comprising a plate-shaped member having a tip end inclined toward said sheet supporting means, said sheet supply means urging the fed sheet against the plate shared member, thereby causing the plate-shaped member to be elastically flexed around a fulcrum of the plate-shaded member to change an inclination angle relative to said sheet supporting means when the sheet fed out by said sheet supply means is urged onto the plate-shaped member to be separated from other sheets by riding over it, wherein said separation means further comprises fulcrum means for changing a position of the fulcrum of the plate-shaped member corresponding to the inclined angle thereof.

10. A sheet supply apparatus according to claim 9, wherein said fulcrum means has at least a first fulcrum portion around which said plate-shaped member is firstly flexed, and a second fulcrum portion against which said plate-shaped member is urged when the inclination angle of said plate-shaped member increased.

11. A sheet supply apparatus according to claim 9, wherein said first and second fulcrum portions are defined by stepped portions disposed along a sheet feeding direction.

12. A sheet supply apparatus according to claim 9, wherein said second fulcrum portion is defined by a ridge disposed at said first fulcrum portion in a sheet feeding direction.

13. A sheet supply apparatus according to claim 9, wherein said plate-shaped member is disposed in an inclined condition so that a tip end, over which the sheet rides, of said plate-shaped member is inclined with respect to a normal plane perpendicular to a sheet feeding direction toward said sheet supporting means.

14. A sheet supply apparatus according to claim 9, wherein said plate-shaped member is made of a synthetic resin film.

15. A recording apparatus comprising:

sheet supporting means for supporting a plurality of sheets;

sheet supply means for feeding out the sheets supported by said sheet supporting means;

separation means for separating sheets fed out from said sheet supporting means, said separation means comprising a flexible abutment member having an abutment surface with a tip end, and said sheet supply means urging the fed sheet against the abutment surface thereby changing an inclination angle of the abutment surface relative to said sheet supporting means and separating the sheet from other sheets by riding over the abutment surface; and a recording means for recording an image on the sheet separated by said separation means;

wherein the abutment surface of said separation means is inclined toward said sheet supporting means by a predetermined angle with respect to a plane perpendicular to a direction in which the sheets supported by said sheet supporting means are fed out so that the tip end of the abutment surface comes closer to said sheet supporting means.

16. A recording apparatus according to claim 15, wherein said recording means is of ink jet type in which an electrothermal converter is energized in response to a signal to heat ink to a temperature exceeding film boiling point by said electrothermal converter for growing a bubble in the ink to discharge the ink toward the sheet, thus recording the image on the sheet.

17. A recording apparatus comprising:

sheet supporting means for supporting a plurality of sheets;

sheet supply means for feeding out the sheets supported by said sheet supporting means;

separation means comprising a plate-shaped member having a tip end inclined toward said sheet supporting means, said sheet supply means urging the fed sheet against the plate shaped member, thereby causing the plate-shaped member to be elastically flexed around a fulcrum of the plate-shaped member to change an inclination angle relative to said sheet supporting means when the sheet fed out by said sheet supply means is urged onto the plate-shaped member to be separated from other sheets by riding over it; and a recording means for recording an image on the sheet separated by said separation means;

wherein said separation means further comprises fulcrum means for changing a position of a fulcrum of the plate-shaped member corresponding to the inclined angle thereof.

18. A recording apparatus according to claim 17, wherein said recording means is of ink jet type in which an electrothermal converter is energized in response to a signal to heat ink to a temperature exceeding film boiling point by said electrothermal converter for growing a bubble in the ink to discharge the ink toward the sheet, thus recording the image on the sheet.

* * * * *

UNITED STATES PATENT AND TRADEMARK OFFICE

CERTIFICATE OF CORRECTION

PATENT NO. : 6,045,220

DATED : April 4, 2000

INVENTOR(S): TAKEHIKO KIYOHARA, ET AL.

It is certified that error appears in the above-identified patent and that said Letters Patent is hereby corrected as shown below:

COVER PAGE AT ITEM [*]:
CPA: Insert --[*] Notice: This patent issued on a continued prosecution application filed under 37 CFR 1.53(d), and is subject to the twenty year patent term provisions of 35 U.S.C. 154(a)(2).--.

COVER PAGE AT ITEM [57] ABSTRACT:
Line 11, "flexed" should read --being flexed--.

COLUMN 2:
Line 39, "module" should read --modulus--.

COLUMN 3:
Line 32, "flexed" should read --being flexed--; and
Line 62, "flexed" should read --being flexed--.

COLUMN 4:
Line 35, "on" should read --a--.

COLUMN 5:
Line 40, sectional" should read --a sectional--.

UNITED STATES PATENT AND TRADEMARK OFFICE

CERTIFICATE OF CORRECTION

PATENT NO. : 6,045,220

DATED : April 4, 2000

INVENTOR(S): TAKEHIKO KIYOHARA, ET AL.

It is certified that error appears in the above-identified patent and that said Letters Patent is hereby corrected as shown below:

COLUMN 6:
Line 36, "in synchronous" should read --synchronously--.

COLUMN 11:
Line 18, "a" should read --$\alpha$--.

COLUMN 12:
Line 4, " $F_5'=F_5=F_8 \cos A_1$. " should read --$F_5'=F_5=F_8\cos A_1{}^0$--.

COLUMN 13:
Line 2, "$A_1{}^0 \leq A_2{}^0$." should read --$A_1{}^0 \geq A_2{}^0$.--.

COLUMN 16:
Line 3, "not" should read --do not--;
Line 32, "nous" should read --nism--; and
Line 40, "for" should read --from--.

COLUMN 17:
Line 43, "teeth is" should read --teeth are--;
Line 49, "had" should read --have--; and
Line 50, "has" should read --have--.

UNITED STATES PATENT AND TRADEMARK OFFICE

CERTIFICATE OF CORRECTION

PATENT NO. : 6,045,220

DATED : April 4, 2000

INVENTOR(S): TAKEHIKO KIYOHARA, ET AL.

It is certified that error appears in the above-identified patent and that said Letters Patent is hereby corrected as shown below:

COLUMN 18:
Line 65, "has" should read --having--.

COLUMN 20:
Line 4, "2 $A_6^0$" should read --2 $A_6^0$,--; and
Line 16, "$F_{15} = F_4/\cos A_6^0$" should read --$F_{15} = F_4/\cos A_6^0$--.

COLUMN 21:
Line 21, "the $A_6^0$" should read --than $A_6^0$--; and
Line 22, "contructural" should read --constructural--.

COLUMN 23:
Line 28, "for revolve" should read --to revolve--.

COLUMN 26:
Line 19, "$F_{17} - F'_{17} = A_{10}/L_{13}^2 K_2 - A_{10}/L_3^2 K_2 = (A_{10}/K_2) \times \{[L_3^2 - L_{13}^2) \div (L_{13}^2 \times L_3^2)\}$"
should read --$F_{17}-F'_{17}=A_{10}/L_{13}^2K_2-A_{10}/L_3^2K_2 = (A_{10}/K_2)x\{[L_3^2-L_{13}^2)\div(L_{13}^2xL_3^2)\}$--.
Line 66, "with the result that" should be deleted.

UNITED STATES PATENT AND TRADEMARK OFFICE

CERTIFICATE OF CORRECTION

PATENT NO. : 6,045,220

DATED : April 4, 2000

INVENTOR(S): TAKEHIKO KIYOHARA, ET AL.

It is certified that error appears in the above-identified patent and that said Letters Patent is hereby corrected as shown below:

COLUMN 27:

Line 64, "plate shared" should read --plate-shaped--; and

Line 66, "shaded" should read --shaped--.

Signed and Sealed this

Third Day of April, 2001

*Attest:*

Nicholas P. Godici

NICHOLAS P. GODICI

*Attesting Officer*

*Acting Director of the United States Patent and Trademark Office*